US007954818B2

(12) United States Patent
Fukatsu et al.

(10) Patent No.: US 7,954,818 B2
(45) Date of Patent: Jun. 7, 2011

(54) SHEET STACKING APPARATUS AND IMAGE FORMING APPARATUS

(75) Inventors: Yasuo Fukatsu, Abiko (JP); Tsuyoshi Moriyama, Toride (JP); Hitoshi Kato, Toride (JP); Naoki Ishikawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 120 days.

(21) Appl. No.: 11/962,330

(22) Filed: Dec. 21, 2007

(65) Prior Publication Data

US 2008/0157466 A1 Jul. 3, 2008

(30) Foreign Application Priority Data

Dec. 28, 2006 (JP) ..... 2006-354221
Dec. 18, 2007 (JP) ..... 2007-326092

(51) Int. Cl.
*B65H 39/10* (2006.01)

(52) U.S. Cl. ..... 271/300; 271/279; 271/189

(58) Field of Classification Search ..... 271/279, 271/283, 289, 290, 292, 293, 296, 300, 303, 271/305, 189, 194, 196, 197, 204, 85, 213, 271/214, 215, 217, 218, 220, 900; 414/790.9
See application file for complete search history.

(56) References Cited

U.S. PATENT DOCUMENTS

| | | | | |
|---|---|---|---|---|
| 3,106,393 | A * | 10/1963 | Koch | 271/279 |
| 5,014,974 | A * | 5/1991 | Jones et al. | 271/189 |
| 5,497,987 | A * | 3/1996 | Henn et al. | 271/204 |
| 5,671,920 | A * | 9/1997 | Acquaviva et al. | 271/307 |
| 5,713,283 | A * | 2/1998 | Eltner et al. | 101/232 |
| 6,446,962 | B1 * | 9/2002 | Taffertshofer | 271/312 |
| 6,926,271 | B2 * | 8/2005 | Hanson et al. | 271/213 |
| 7,597,324 | B2 * | 10/2009 | Obuchi et al. | 271/288 |
| 7,641,195 | B2 * | 1/2010 | Suzuki | 271/307 |
| 2001/0054791 | A1 * | 12/2001 | Goldbeck et al. | 271/220 |
| 2005/0006840 | A1 * | 1/2005 | Kusaka | 271/298 |
| 2005/0029338 | A1 * | 2/2005 | Landwehr | 235/11 |

FOREIGN PATENT DOCUMENTS

JP 6-144682 5/1994

* cited by examiner

*Primary Examiner* — Jeremy Severson
(74) *Attorney, Agent, or Firm* — Fitzpatrick, Cella, Harper & Scinto

(57) ABSTRACT

A discharged sheet is conveyed, by a sheet conveying portion movable above sheet stacking portions while supporting a sheet, to selected one among plural sheet stacking portions. When the sheet is conveyed to the selected sheet stacking portion by the sheet conveying portion, a member for preventing a bringing-together provided in the main body of the apparatus prevents a sheet bundle, stacked in a sheet stacking portion at the upstream side of the selected sheet stacking portion, from being brought together by the sheet conveyed above the upstream sheet stacking portion by the sheet conveying portion.

9 Claims, 23 Drawing Sheets

SHEET STACKING APPARATUS AND IMAGE FORMING APPARATUS

BACKGROUND OF THE INVENTION

1. Field of the Invention

The present invention relates to a sheet stacking apparatus and an image forming apparatus, and more particularly to such an apparatus adapted to discharge and stack selectively sheets on plural sheet stacking portions, thereby providing a sheet stacking apparatus and an image forming apparatus capable of sheet stacking without destructing a bundle of stacked sheets and without causing a stain or a damage by friction in the sheets.

2. Description of the Related Art

In an image forming apparatus for forming an image on a sheet, a higher speed in image formation is recently intended as a result of advances in the technology. As a result of such higher speed in image formation, the sheet discharged from a main body of the image forming apparatus is discharged at a higher speed, so that, in a sheet stacking apparatus of a large capacity for stacking the discharged sheets, requested are not only a large capacity but also a highly precise sheet stacking.

Among the prior image forming apparatuses, there is known one enabling a stacking of large capacity, by arranging a plurality of such large-capacity sheet stacking apparatuses in parallel (cf. Japanese Patent Application Laid-open No. 06-144682). In the case that such large-capacity sheet stacking apparatuses are arranged in parallel, when a sheet is to be stacked in a downstream sheet stacking apparatus, the sheet is passed through the upstream sheet stacking apparatus and is guided to the downstream sheet stacking apparatus.

In such case of stacking a sheet in the downstream sheet stacking apparatus, the conveyed sheet may cause a hanging-down or a flapping at the trailing end thereof, thereby liable to cause a destruction of a sheet bundle already stacked in the upstream sheet stacking apparatus or a stain or a damage to the sheet by friction. For this reason, there is known a sheet stacking apparatus, at the upstream side, having a sheet guide above the already stacked sheet bundle in order to avoid the destruction of the already stacked sheet bundle or the stain or the damage to the sheet by friction.

On the other hand, the sheet stacking apparatus is recently requested to stack a large amount of sheets without increasing the dimension of the apparatus. For this reason, an increase in the capacity is intended for example by providing a sheet stacking apparatus with plural sheet stacking portions and, in the case of discharge of sheets of a small size such as A4-size, stacking such sheets in the respective sheet stacking portions. Also in the case of stack of a large-sized sheet such as A3-size, the stacking of such large-sized sheets is made possible by stacking such sheets bridging plural sheet stacking portions.

In the case that such plural sheet stacking portions are disposed within a single sheet stacking apparatus, the sheets are discharged and stacked selectively on such plural sheet stacking portions. When a sheet stacking portion at the downstream side is selected for sheet discharge, the sheet is made to pass through the upstream sheet stacking portion and directed to the sheet stacking portion at the downstream side.

However, in the case of sheet stacking on the downstream sheet stacking portion, the conveyed sheet may have a hanging-down or a flapping of the trailing end thereof thereby causing the sheets, already stacked in the upstream sheet stacking portion, to be moved together. Such movement together of the sheets may cause a destruction of the sheet bundle or a stain or a damage to the sheet by the friction.

SUMMARY OF THE INVENTION

The present invention has been made in consideration of the above circumstances, and an object thereof is to provide a sheet stacking apparatus and an image forming apparatus, capable of sheet stacking without causing a destruction of the sheet bundle or a stain or a damage by friction.

The present invention provides a sheet stacking apparatus including plural sheet stacking portions for stacking sheets, a sheet conveying portion for conveying a sheet in either one of the plural sheet stacking portions, and a guide member disposed above a first sheet stacking portion to guide a sheet conveyed by the sheet conveying portion to a second sheet stacking portion on a downstream side of the first sheet stacking portion in a sheet conveying direction in which the sheet conveying portion conveys a sheet, wherein the guide member is disposed to extent from an upstream end, toward a downstream side in the sheet conveying direction, of the first sheet stacking portion.

The present invention also provides a sheet stacking apparatus including plural sheet stacking portions for stacking sheets, a sheet conveying portion for conveying a sheet in either one of the plural sheet stacking portions, and a guide member disposed above a sheet stacking portion at an upstream side in a sheet conveying direction, for guiding a sheet conveyed by the sheet conveying portion above the sheet stacking portion at the upstream side in the sheet conveying direction, when the sheet conveying portion conveys a sheet to, among the plural sheet stacking portions, a sheet stacking portion at a downstream side in the sheet conveying direction, wherein the guide member is provided on a plane, perpendicular to the sheet conveying direction, of a frame member of a main body of the apparatus.

The present invention further provides a sheet stacking apparatus including plural sheet stacking portions for stacking sheets, a sheet conveying portion for conveying a sheet in either one of the plural sheet stacking portions, and a hold member for holding, from above, the sheets stacked in a sheet stacking portion at an upstream side in a sheet conveying direction, when the sheet conveying portion conveys a sheet to, among the plural sheet stacking portions, a sheet stacking portion at a downstream side in the sheet conveying direction.

The present invention enables to prevent, by the guide member or by the hold member, the sheets stacked in a sheet stacking portion at the upstream side of the selected sheet stacking portion, from being brought together or being subjected to a friction by the sheet conveyed above the sheet stacking portion of the upstream side by the sheet conveying portion. Thus, the sheet can be stacked without destructing the sheet bundle or without causing a stain or a damage to the sheet by the friction.

Further features of the present invention will become apparent from the following description of exemplary embodiments, with reference to the attached drawings.

DESCRIPTION OF THE EMBODIMENTS

In the following, a best mode for exploiting the present invention will be described in detail, with reference to the attached drawings.

Figure 1:
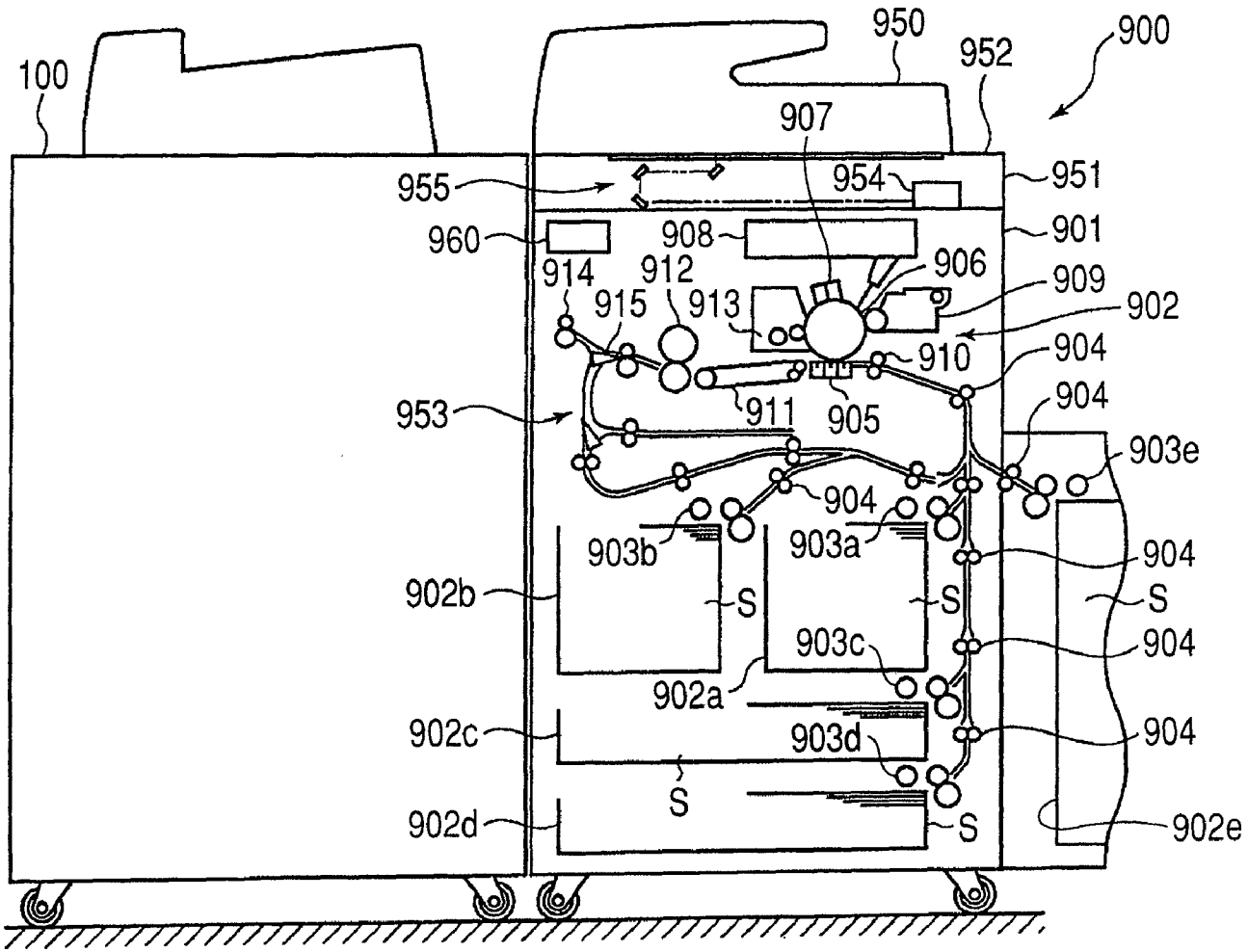
FIG. 1 is a view illustrating a construction of an image forming apparatus, equipped with a sheet stacking apparatus of a first exemplary embodiment of the present invention.

FIG. 1 is a view illustrating a construction of an image forming apparatus, equipped with a sheet stacking apparatus of a first exemplary embodiment of the present invention.

In FIG. 1, shown are an image forming apparatus 900 and a main body 901 of the image forming apparatus, and, in an upper part of the main body 901 of the image forming apparatus, an image reading apparatus 951 equipped with a scanner unit 955 and an image sensor 954 is provided. Also on an upper surface of the image reading apparatus 951, provided is a document feeding apparatus 950 for feeding an original document to a platen glass 952.

Also in a central part of the main body 901 of the image forming apparatus, an image forming portion 902 for forming an image on a sheet, and a two-side inverting apparatus 953 are provided. The image forming portion 902 includes a cylindrical photosensitive drum 906, a charging device 907, a developing device 909, a cleaning apparatus 913 etc., and a fixing apparatus 912, paired discharge rollers 914 etc. are disposed at the downstream side of the image forming portion 902.

Also the main body 901 of the image forming apparatus is connected to a stacker 100, which is a sheet stacking apparatus for stacking an image-bearing sheet, which is discharged from the main body 901 of the image forming apparatus after the image formation. A controller 960 controls the main body 901 of the image forming apparatus and the stacker 100.

In the following, an image forming operation in the main body 901 of the image forming apparatus of the above-described construction.

When an image formation signal is released from the controller 960, an original is placed on the platen glass 952 by the original feeding apparatus 950, and an image of the original is read by the image reading apparatus 951, and the read digital data are entered into an exposure device 908. The exposure device 908 causes a light, corresponding to the digital data, to irradiate the photosensitive drum 906.

In this state, the surface of the photosensitive drum 906 is uniformly charged by the charging device 907, and, in response to the light irradiation, an electrostatic latent image is formed on the surface of the photosensitive drum. This electrostatic latent image is developed by the developing device 909 to form a toner image on the surface of the photosensitive drum.

On the other hand, when a sheet feeding signal is released from the controller 960, a sheet S set in one of cassettes 902*a*-902*d* and a sheet feeding deck 902*e* is conveyed by sheet feed rollers 903*a*-903*e* and paired conveying rollers 904 to registration rollers 910.

Subsequently, the sheet S is conveyed by the registration rollers 910 to a transfer portion including a transfer-separation charger 905, at such timing that the leading end of the sheet matches the leading end of the toner image on the photosensitive drum 906. In such transfer portion, by a transfer bias applied by the transfer-separation charger 905 to the sheet S, the toner image on the photosensitive drum 906 is transferred onto the sheet.

Then the sheet S bearing the transferred toner image is conveyed by a conveyor belt 911 to the fixing apparatus 912, and is pinched and conveyed by a heating roller and a pressure roller of the fixing apparatus 912 whereupon the toner image is thermally fixed. Meanwhile, on the photosensitive drum 906, foreign matters such as a residual toner that remains thereon without being transferred to the sheet are scraped off by a blade of the cleaning apparatus 913, whereby the surface of the photosensitive drum 906 is cleaned and prepared for a next image formation.

The sheet after image fixation is either conveyed by the paired discharge rollers 914 to the stacker 100, or is conveyed by a change-over member 915 to the two-side inverting apparatus 953, and is again subjected to an image formation.

Figure 2:
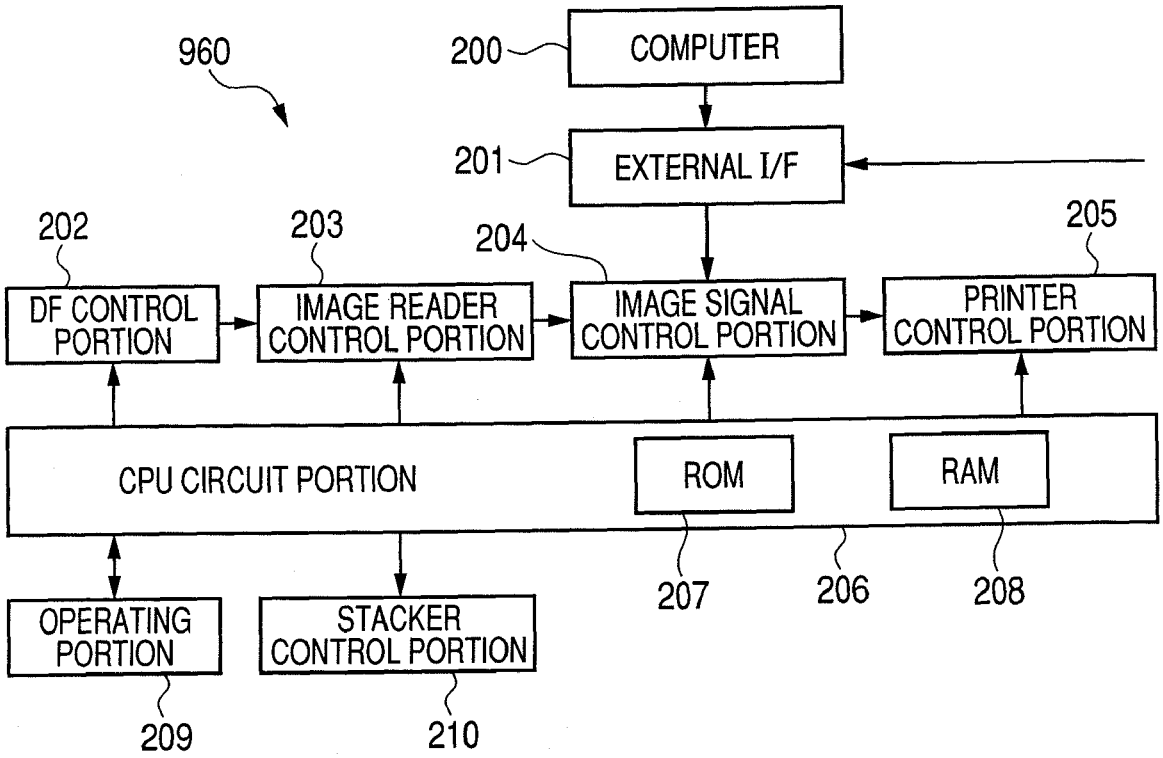
FIG. 2 is a control block diagram of a controller provided in the image forming apparatus.

FIG. 2 is a block diagram illustrating the construction of the controller 960. The controller 960 includes a CPU circuit portion 206. The CPU circuit portion 206 incorporates an unillustrated CPU, a ROM 207 and a RAM 208, and comprehensively controls, by a control program stored in the ROM 207, a DF (document feeder) control portion 202, an operation portion 209, an image reader control portion 203, an image signal control portion 204, a printer control portion 205, and a stacker control portion 210. The RAM 208 is used for temporarily storing the control data and used as a work area for operations associated with the control.

The DF (document feeder) control portion 202 executes a drive control on the original document feeding apparatus 950 based on an instruction from the CPU circuit portion 206. The image reader control portion 203 executes a drive control on the scanner unit 955 and the image sensor 954 provided in the image reading apparatus 951, and transfers an analog image signal, output from the image sensor 954, to the image signal control portion 204.

The image signal control portion 204 converts the analog image signal from the image sensor 954 into a digital signal, then applies various processes thereon, and converts the digital signal into a video signal for supply to the printer control portion 205.

The image signal control portion 204 applies various processes to a digital image signal supplied from a computer 200 or from the exterior through an external I/F 201, and converts the digital image signal into a video signal for supply to the printer control portion 205. The processing operations of the image signal control portion 204 are controlled by the CPU circuit portion 206.

The printer control portion 205 drives the exposure device 908, based in the input video signal and through an unillustrated exposure control portion. The operation portion 209 includes plural keys for setting various functions relating to image formation, and a display portion for displaying information indicating the set state. It outputs a key signal, corresponding to the manipulation of each key, to the CPU circuit portion 206, and displays, based on a signal from the CPU circuit portion 206, corresponding information on the display portion.

Figure 3:
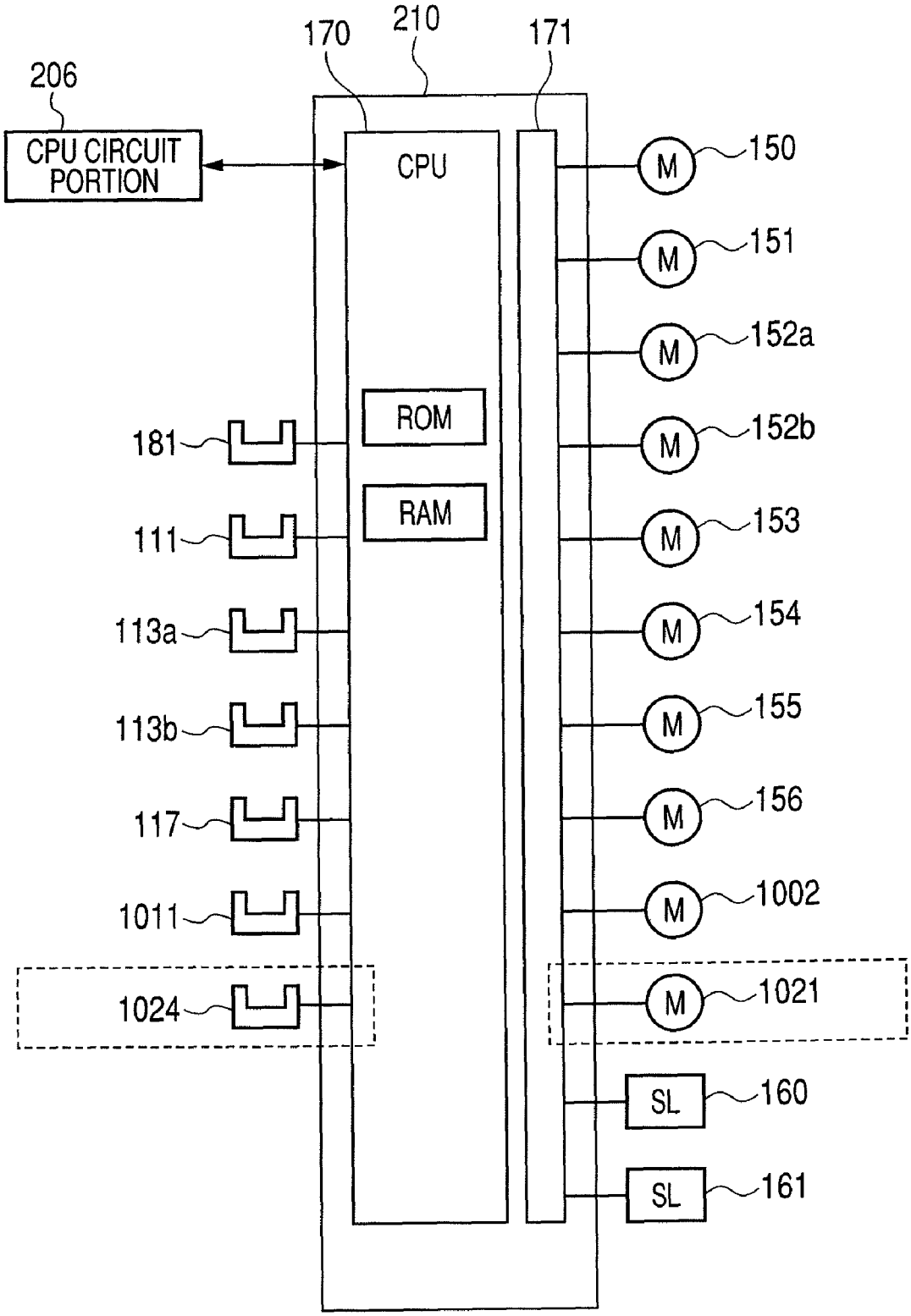
FIG. 3 is a control block diagram of a stacker control portion, mounted in a stacker constituting the sheet stacking apparatus.

The stacker control portion 210 is mounted on the stacker 100 and executes drive control on the entire stacker by information exchange with the CPU circuit portion 206. The stacker control portion 210 is constituted, as illustrated in FIG. 3, of a CPU 170 for executing information exchange with the CPU circuit portion 206, a driver portion 171 and the like. The driver portion 171 is connected to various motors, solenoids and sensors including a sheet surface detection sensor 117.

Figure 4:
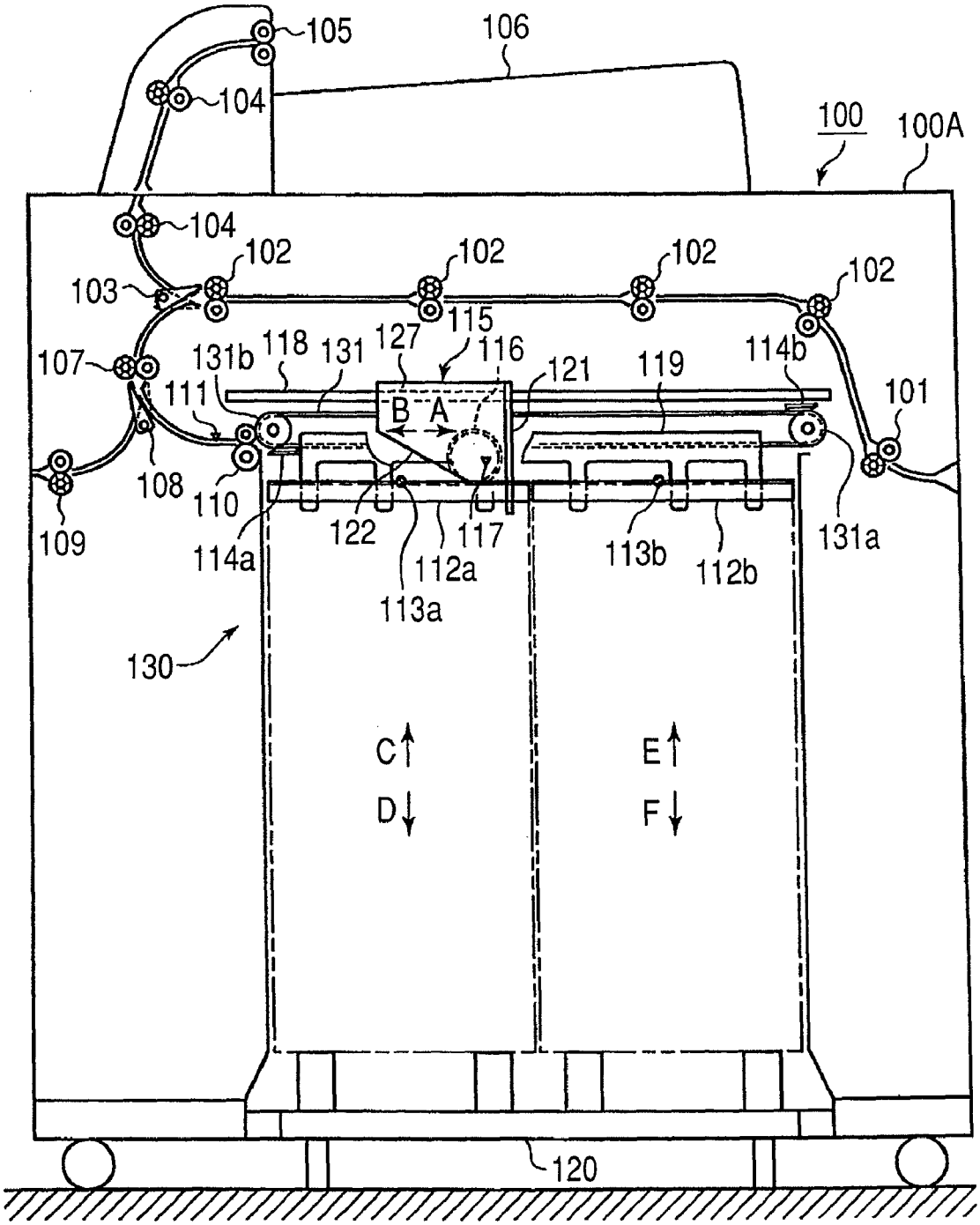
FIG. 4 is a view illustrating the construction of the stacker.

FIG. 4 is a view illustrating the construction of the stacker 100. The stacker 100 is provided, on an upper surface thereof, with a top tray 106 for stacking a sheet discharged from the main body 901 of the image forming apparatus. The stacker 100 is equipped with a stack portion 130 for stacking a sheet, formed by plural sheet stacking portions which are arranged along the sheet discharging direction. In the present embodiment, the stack portion 130 provides adjoining two sheet stacking portions which are first stacker tray 112*a* serves as a first sheet stacking portion and second stacker tray 112*b* serves as a second sheet stacking portion. It is effective for a stacker which provides three or more sheet stacking portions.

The first and second stacker trays 112*a*, 112*b* of the stack portion 130 are independently made, as illustrated in FIG. 4, capable of being elevated or descended as in directions indicated by arrows C, D and arrows E, F by first and second stacker tray elevating motors 152*a*, 152*b* (cf. FIG. 3).

The stacker 100 is further equipped with a top tray change-over member 103 which is driven by a change-over member solenoid 160 (cf. FIG. 3) and which directs the sheet S, conveyed into the stacker, either to the top tray 106 constituting another sheet stack portion or to the stack portion 130.

In FIG. 4, illustrated are a stacker main body 100A which is the main body of the apparatus, and a stacker exist change-over member 108, which is driven by an exit change-over solenoid 161 (cf. FIG. 3) and shifted to a broken-lined position when the sheet is to be discharged to an unillustrated downstream sheet processing apparatus (stacker apparatus).

In FIG. 4, also illustrated is a sheet guide unit 115 for guiding the sheet, discharged by the paired discharge rollers 110, to the stacker tray side. The sheet guide unit 115 rotates counterclockwise and is equipped with an elastic rollet belt 116 for pulling the sheet to above the stacker tray and a leading end stopper 121 constituting an impingement portion for positioning the sheet in the discharge direction. The rollet belt 116 is driven by a rollet belt motor 154 (cf. FIG. 3).

The sheet guide unit 115 pulls the discharged sheet, by the rollet belt 116, into between the rollet belt 116 and the stacker tray 112*a* (or stacker tray 112*b*), and causes the sheet to impinge on the leading end stopper 121. Thus, the discharged sheet can be stacked in a position state on the stacker tray 112*a* or 112*b*.

The sheet guide unit 115 is mounted movable in directions of arrows A and B along a slide shaft 118, and is moved by a guide motor 153 (cf. FIG. 3) to a position corresponding to a sheet size. Also in a frame 127 of the sheet guide unit 115, a tapered surface 122 is formed in order to guide the pulled-in sheet to the rollet belt 116.

A sheet surface detection sensor 117 is provided in order to maintain a constant distance between the sheet guide unit 115 and the upper surface of the sheets. In the present exemplary embodiment, the upper surface of the sheets is set lower than the paired discharge rollers 110, in order that, when the stacked sheets are curved upwards, the leading end of the next conveyed sheet does not stuck in the paired discharge rollers 110.

There are also provided home position sensors 113*a*, 113*b*, and such home position sensors 113*a*, 113*b* detect home positions of the first and second stacker trays 112*a*, 112*b*. Also these serve as sheet surface detection sensors for the first and second stacker trays 112*a*, 112*b* during the sheet stacking operation.

The first and second stacker trays 112*a*, 112*b* are positioned by the home position sensors 113*a*, 113*b*, in the case of the sheet discharge, at home position enabling sheet stacking as illustrated in FIG. 4. When the first and second stacker trays 112*a*, 112*b* are at the home positions, the sheet stacking surfaces thereof are in a same position.

A driving belt 131 is wound around a driving roller 131*a* and an idler roller 131*b* and is rendered movable counterclockwise by a driving belt motor 155. Grippers 114*a* and 114*b* are mounted on the driving belt.

The grippers 114*a*, 114*b* constitute, together with the driving belt 131, a sheet conveying portion for conveying the sheet. In the present exemplary embodiment, the sheet is conveyed by being gripped (held) at the leading end portion of the sheet, which is an upstream side end portion in the sheet discharging direction. Each of the grippers 114*a*, 114*b* is equipped with an unillustrated gripping portion that that can be opened in a V-shape, and is mounted in the driving belt in a state where the gripping portion is urged in a closing direction by an unillustrated spring.

The sheet discharged by the paired discharge rollers 110 is pushed into the gripping portion whereby the sheet is held. The grippers 114*a*, 114*b* may also be constructed in such a manner that an elastic member such as a sponge is provided in the gripping portion so as to protect the sheet, and that the sheet is held by such elastic member.

Figure 5:
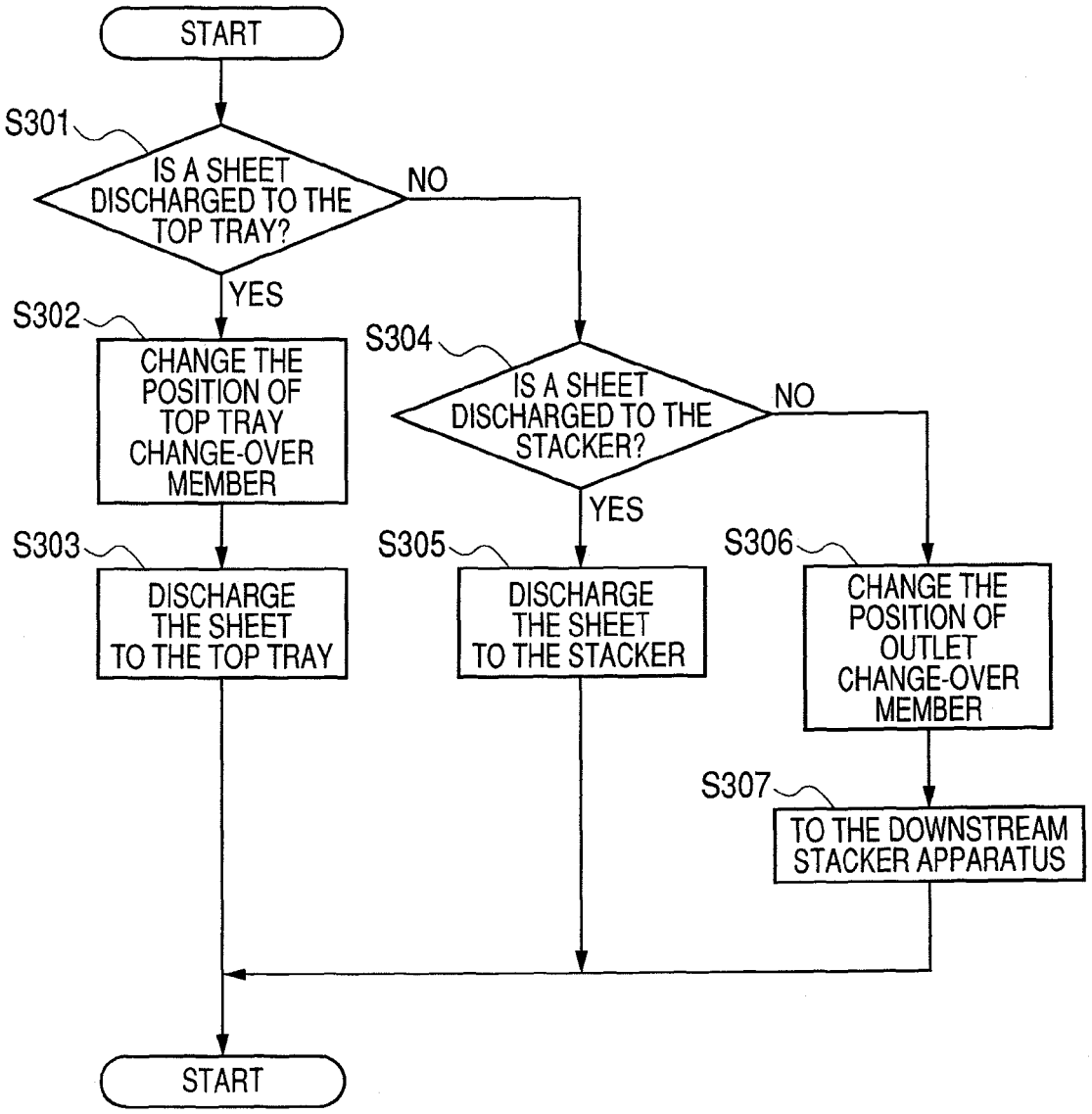
FIG. 5 is a flow chart describing sheet stacking operation of the stacker.

In the following, the sheet stacking operation of the stacker 100 of the above-described construction will be described with reference to a flow chart shown in FIG. 5.

As illustrated in FIG. 4, a sheet S discharged from the main body 901 of the image forming apparatus is conveyed into the interior of the stacker 100 by paired entrance rollers 101, and is further conveyed by paired conveying rollers 102 to the top tray change-over member 103. The paired entrance rollers 101 are driven by an entrance conveying motor 150 illustrated in FIG. 3, and the paired conveying rollers 102 are driven by a conveying motor 151 illustrated in FIG. 3.

Before the sheet conveyance, information on the sheet, such as a sheet size, a sheet type and a sheet destination is sent to the stacker control portion 210 from the controller 960 (CPU circuit portion 206 thereof) of the main body 901 of the image forming apparatus.

The stacker control portion 210 discriminates whether the destination of discharge of the sheet, sent from the controller 960 is the top tray 106 (S301). In the case that the destination of discharge of the sheet is the top tray 106 (Y in S301), the top tray change-over member 103 is shifted to the broken-lined position illustrated in FIG. 4 by the change-over member solenoid 160 (cf. FIG. 3) (S302). Thus, the sheet S is guided to the paired conveying rollers 104 and is thereafter discharged by paired discharge rollers 105 onto the top tray 106 (S303) and stacked thereon.

In the case that the destination of discharge of the sheet is not the top tray 106 (N in S301), then discriminated is whether the destination of discharge of the sheet is stacker trays 112*a*, 112*b* (S304). In the case that the destination of discharge is determined as not the stacker trays 112*a*, 112*b* (N in S304), for example in the case that the destination of discharge of the sheet is determined as an unillustrated downstream stacker apparatus, the exit change-over member 108 is shifted to a broken-lined position illustrated in FIG. 4 (S306). Thus the sheet conveyed by the paired conveying rollers 102 is conveyed by paired conveying rollers 107 to paired exit rollers 109, and further conveyed to the unillustrated downstream stacker apparatus (S307).

Figure 6A:
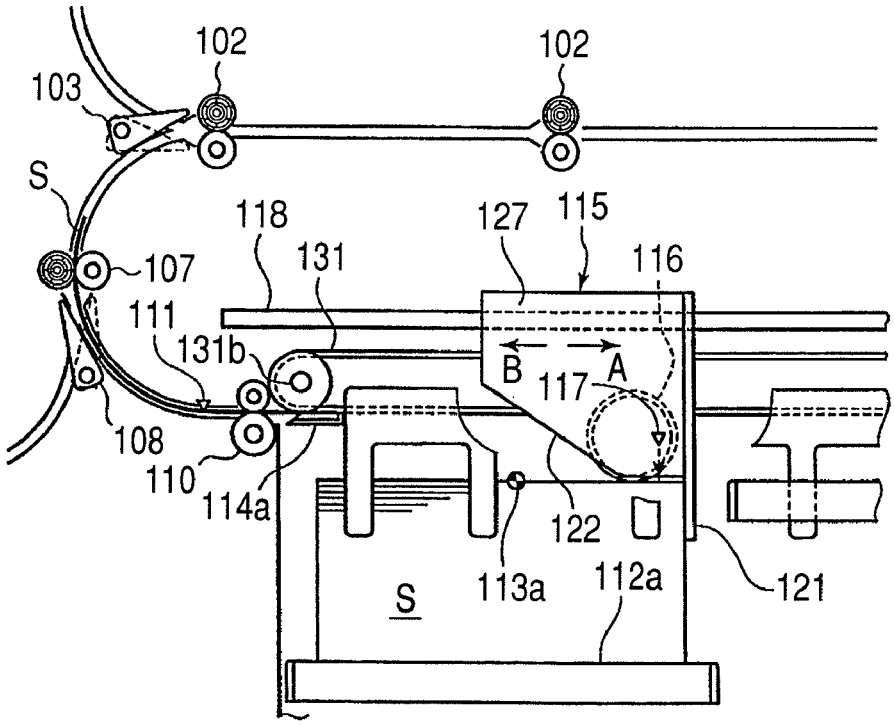
FIGS. 6A and 6B are first views illustrating sheet stacking operations for a first stacker tray provided in the stacker.

In the case that the destination of discharge of the sheet is the stacker trays 112*a*, 112*b* (Y in S304), the top tray change-over member 103 and the exit change-over member 108 are shifted to solid-lined positions as illustrated in FIG. 6A.

Thus, the sheet S is conveyed, under guidance by the top tray change-over member 103 and the exit change-over member 108 that have been shifted to the solid-lined positions as illustrated in FIG. 6A, to the paired discharge rollers 110. Before the sheet S reaches the paired discharge rollers 110, a passing timing of the leading end is detected by a timing sensor 111, disposed at the upstream side of the paired discharge rollers 110. Thereafter, the sheet S is conveyed by the paired discharge rollers 110 to a gripper 114*a* in a stopped stand-by state, and the leading end portion is held by the gripper 114*a*.

Figure 6B:
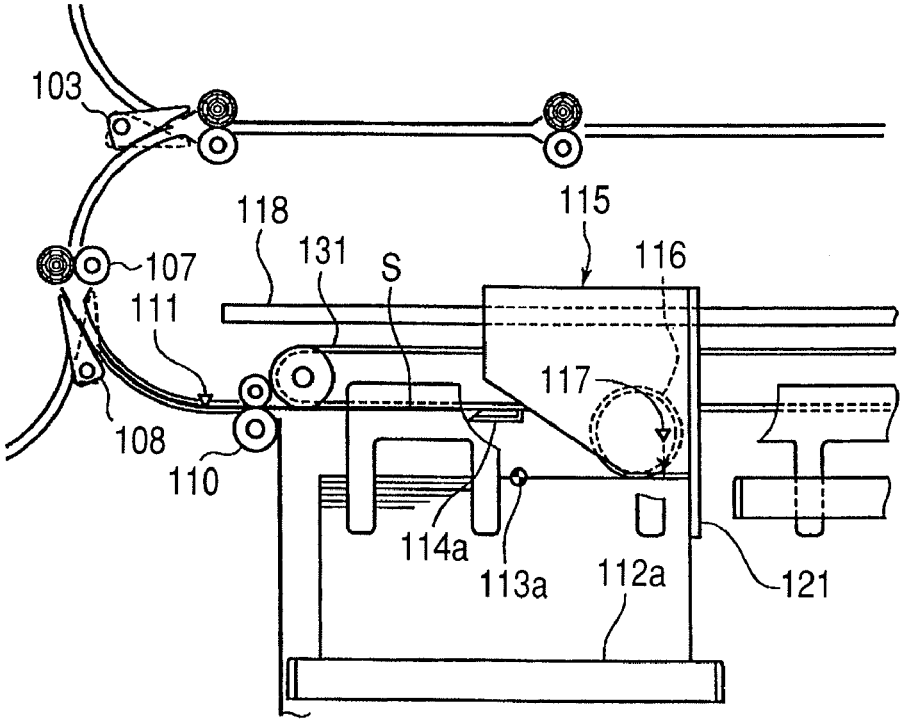

In synchronization with this operation, the driving belt 131 is driven counterclockwise, whereby the gripper 114*a* holding the leading end of the sheet is displaced together with the driving belt 131. Thus, the sheet S is conveyed, as illustrated in FIG. 6B, above and along the first stacker tray 112*a*.

In the case that the sheet is a small-sized sheet such as of A4-size, when the gripper 114*a* passes the tapered portion 122 formed at the gripper side of the sheet guide unit 115, the sheet S contacts the tapered portion 122 and is detached from the gripper 114*a*. In this state, the sheet guide unit 115 is in a stand-by position at the downstream side of the first stacker tray 112*a* in the sheet discharge direction.

Figure 7A:
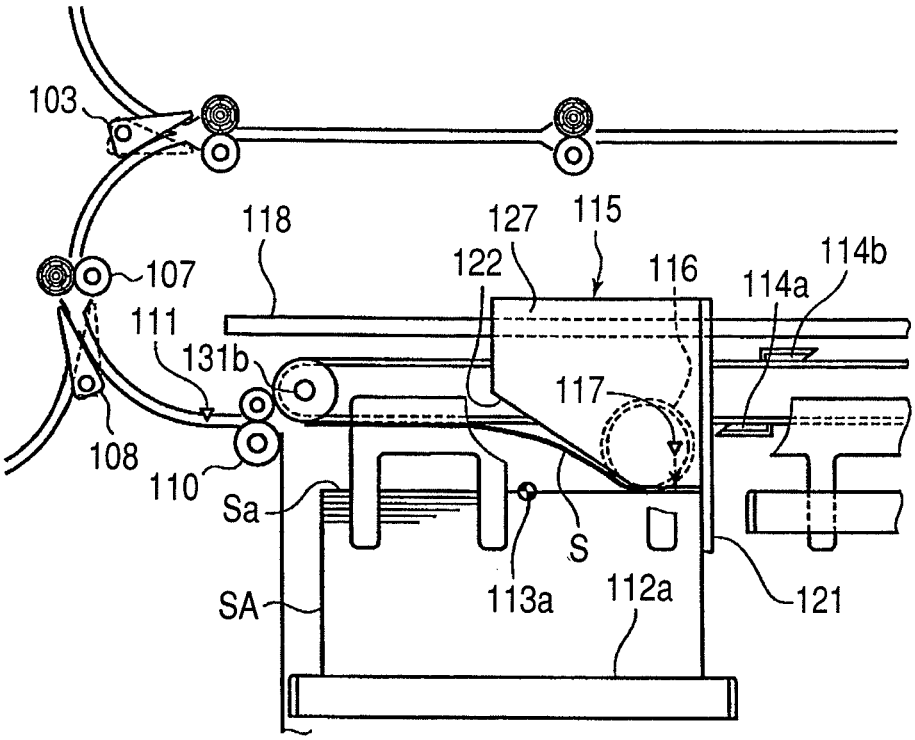
FIGS. 7A and 7B are second views illustrating sheet stacking operations for the first stacker tray provided in the stacker.

Thereafter, the sheet S is conveyed with the leading end thereof being guided by the tapered portion 122 toward the first stacker tray, and is guided to the rollet belt 116 as illustrated in FIG. 7A. In this operation, the sheet S impinges on the rollet belt 116 by the inertial force of conveyance, namely by the speed of conveyance.

Thereafter the rollet belt 116 causes the sheet S to enter between the rollet belt 116 and the first stacker tray 112*a* (or the uppermost sheet Sa when sheets are stacked thereon).

Figure 7B:
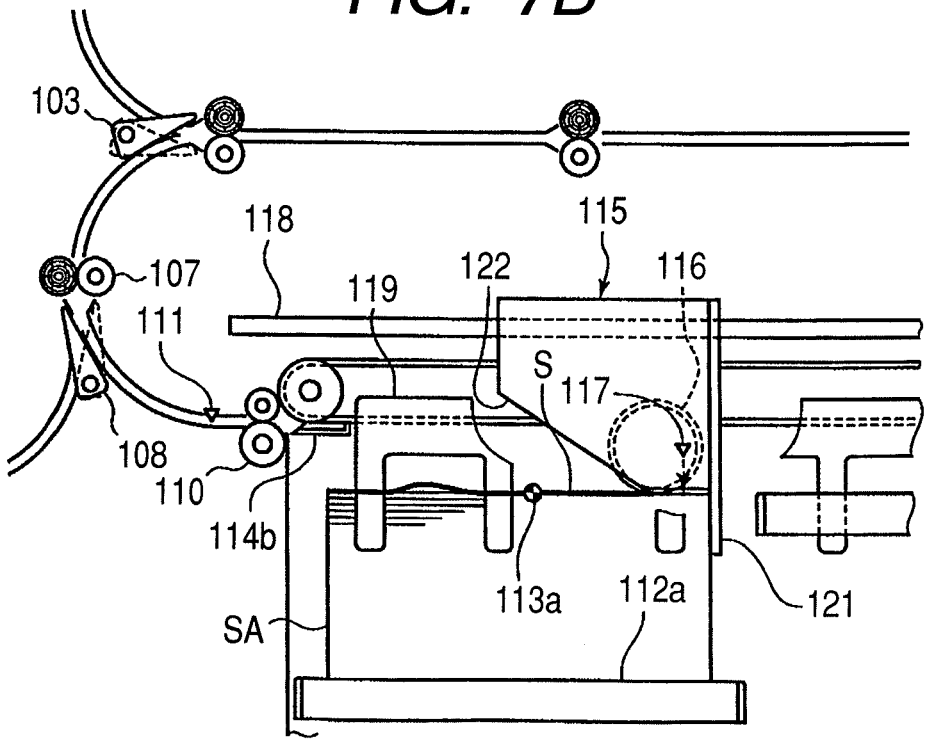

Thereafter, the sheet S is conveyed until the leading end thereof impinges on the stopper 121 as illustrated in FIG. 7B, and is discharged, in a state aligned by the leading end, onto the first stacker tray 112*a* or the uppermost sheet stacked on the first stacker tray 112*a*.

After such discharge of the sheet S, an alignment plate 119 is moved by an alignment motor 156 (cf. FIG. 3) in a transversal direction perpendicular to the sheet conveying direction of a sheet bundle SA, for example toward the front side of the main body of the image forming apparatus, thereby executing an alignment in the width direction. The alignment plate 119, after the alignment of the sheet bundle SA, is retracted by a predetermined amount in the width direction, and awaits the conveyance of a new sheet. Thereafter, the driving belt 131 is circulated to convey sheets alternately by the two grippers 114*a*, 114*b* thereby stacking the sheets in succession on the first stacker tray 112*a*.

In this state, the stacker control portion 210 constantly monitors the upper surface of the discharged and stacked sheet S, by the sheet surface detection sensor 117. When the distance between the sheet guide unit 115 (rollet belt 116 thereof) and the upper surface of the stacked sheets becomes smaller than a predetermined amount, the first stacker tray 112*a* is lowered by a predetermined amount by the first stacker tray elevating motor 152*a*. Such control enables to increase the distance between the sheet guide unit 115 (rollet belt 116 thereof) and the upper surface of the stacked sheets, thereby enabling stacking of a next sheet.

By the repetition of these operations, the sheets S are stacked in succession on the first stacker tray 112*a* and, depending on the number of sheets in a job, the first stacker tray 112*a* eventually becomes fully loaded. The full loaded state of the first stacker tray 112*a* can be detected by counting, in the stacker control portion 210 (FIG. 2), the detection signal of the timing sensor 111 indicating the detection of the sheet S discharged from the paired discharge rollers 110. Otherwise, it can be detected by detecting, by the stacker control portion 210 (FIG. 2), the lowered position of the stacker tray 112*a* and the position of the uppermost sheet.

Figure 8:
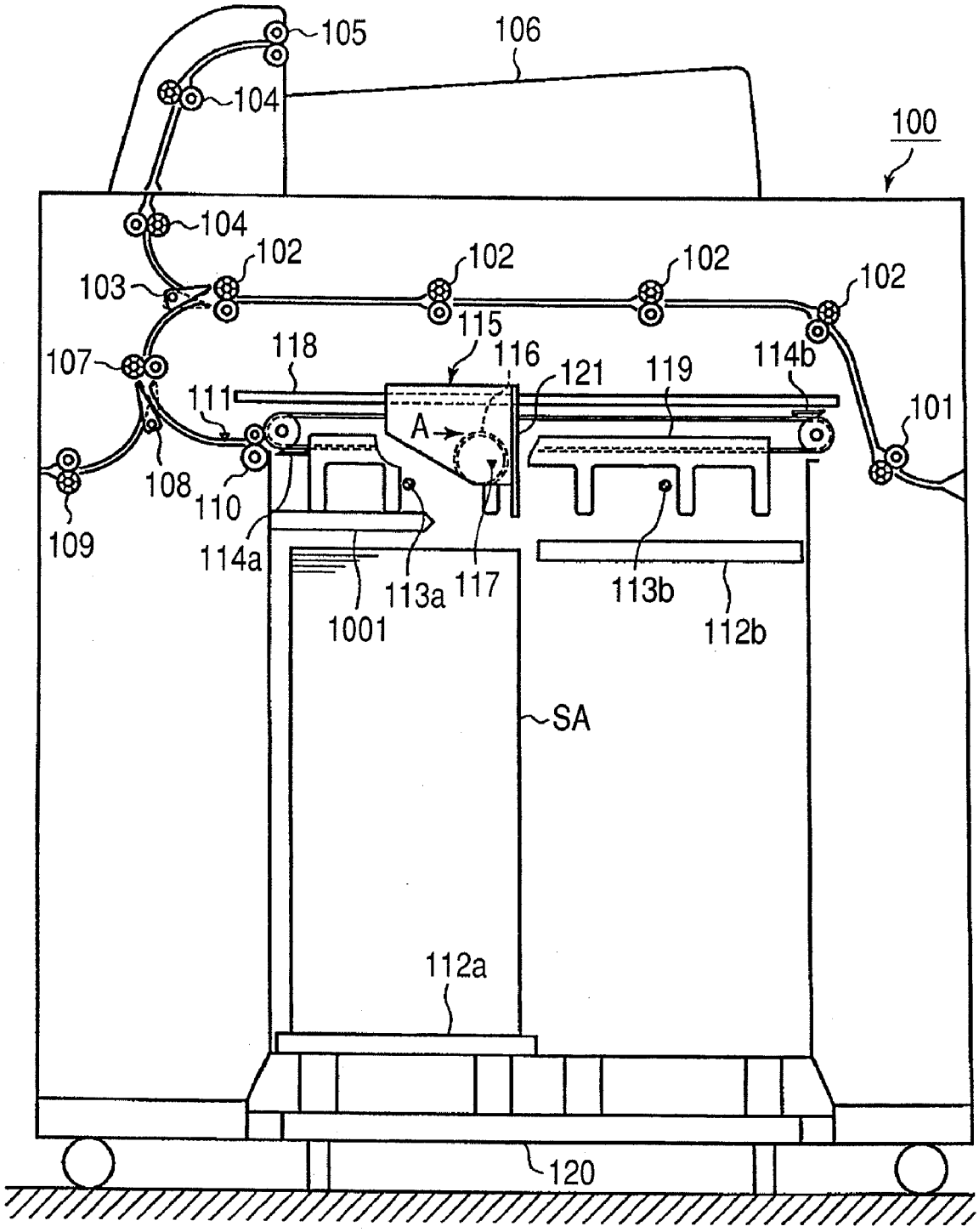
FIG. 8 is a view illustrating a state where the first stacker tray is fully stacked and the stacked sheet bundle is placed, together with the first stacker tray, on a dolly.

When the fully loaded state of the first stacker tray 112*a* is detected by such construction, the stacker control portion 210 (FIG. 2) lowers the first stacker tray 112*a* and places the stacked sheet bundle SA, together with the first stacker tray, on a dolly 120 as illustrated in FIG. 8.

After the first stacker tray 112*a* is thus loaded, the dolly 120, which is an ejection unit provided removably in the main body 100A of the stacker, is taken out from the stacker 100. In this manner, the sheet bundle SA fully loaded on the first stacker tray 112*a* can be taken out integrally.

Thereafter, the sheet bundle is removed from the dolly 120, then the dolly 120 and the first stacker tray 112*a* are mounted in the stacker 100, and the first stacker tray 112*a* is elevated by the first stacker tray elevating motor 152*a*. Thus the first stacker tray 112*a* returns to the state illustrated in FIG. 4 to enable stacking of the new sheets.

However, the number of the sheets S to be stacked may exceed the number of sheets stackable on the first stacker tray 112*a*. In such case, the remaining sheets are stacked on the other stacker tray which is the second stacker tray 112*b*.

Figure 9:
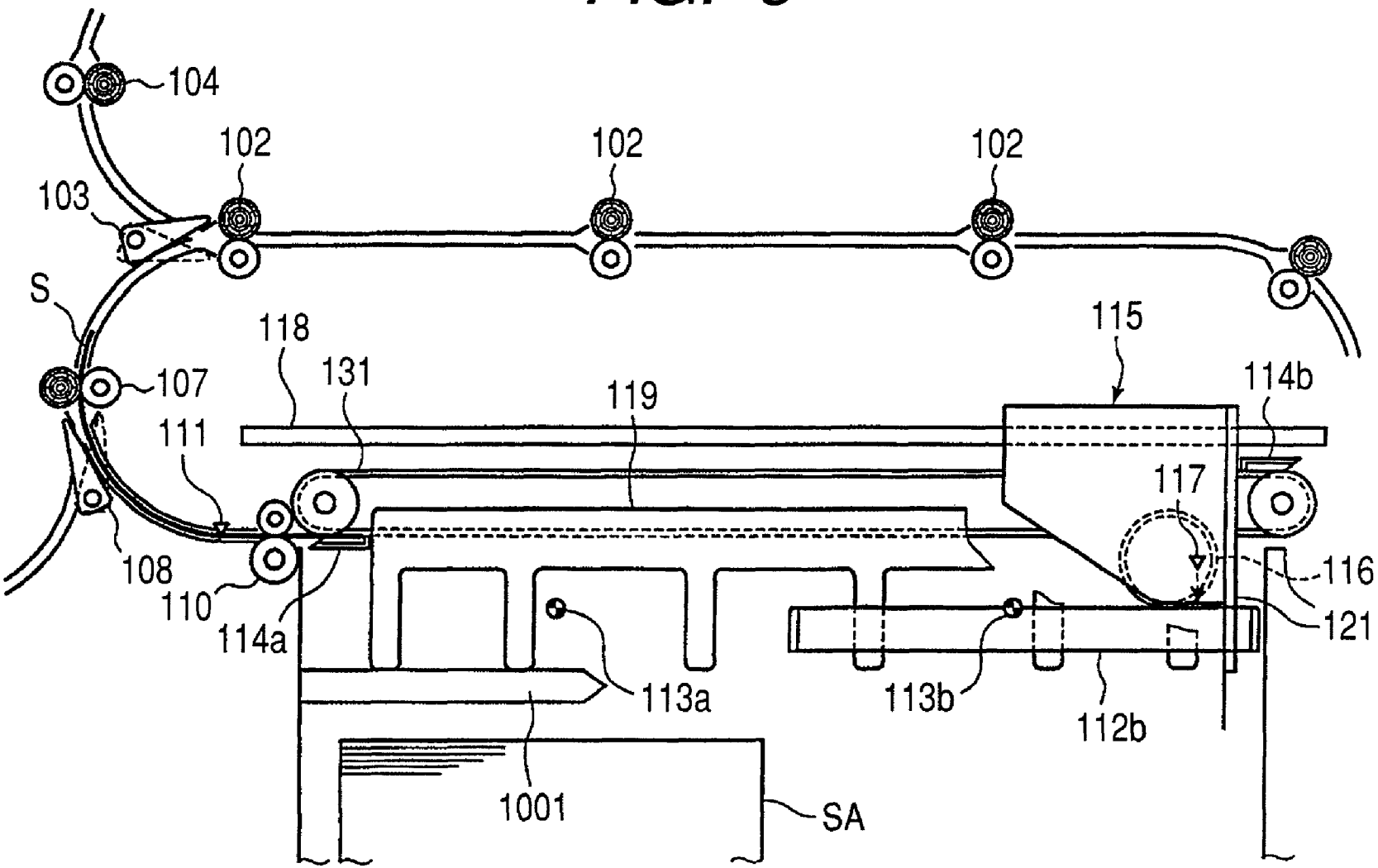
FIG. 9 is a first view illustrating sheet stacking operations for a second stacker tray provided in the stacker.

In such case, the stacker control portion 210 lowers the fully loaded first stacker tray 112*a* so as not to hinder the conveying of the sheet to the second stacker tray 112*b*. Also the stacker control portion 210, before the sheet S is conveyed, moves the guide unit 115 in a direction of an arrow A in FIG. 4, to a stand-by position at the downstream side, in the sheet discharge direction, of the second stacker tray 112*b*, as illustrated in FIG. 9. In this state, the second stacker tray 112*b* waits in the home position.

The stand-by position of the guide unit 115 is, also in the case of sheet stacking on the first stacker tray 112*a*, preferably at the approximate center of the second stacker tray 112*b*, because of the stability. However, in order to increase the stacking amount of the sheets, it may be positioned within such a range that the sheet does not overflow from the first or second stacker tray 112*a*, 112*b*.

When the sheet S from the main body 901 of the image forming apparatus is conveyed by the above-described sheet conveying control to the paired discharge rollers 110, the passing of the leading end of the sheet is detected by the timing sensor 111. Thereafter, the sheet is gripped by the gripper 114*a* in a stopped stand-by position, and the driving belt 131 is driven counterclockwise according to the timing of detection of the leading end of the sheet by the timing sensor 111.

Figure 10A:
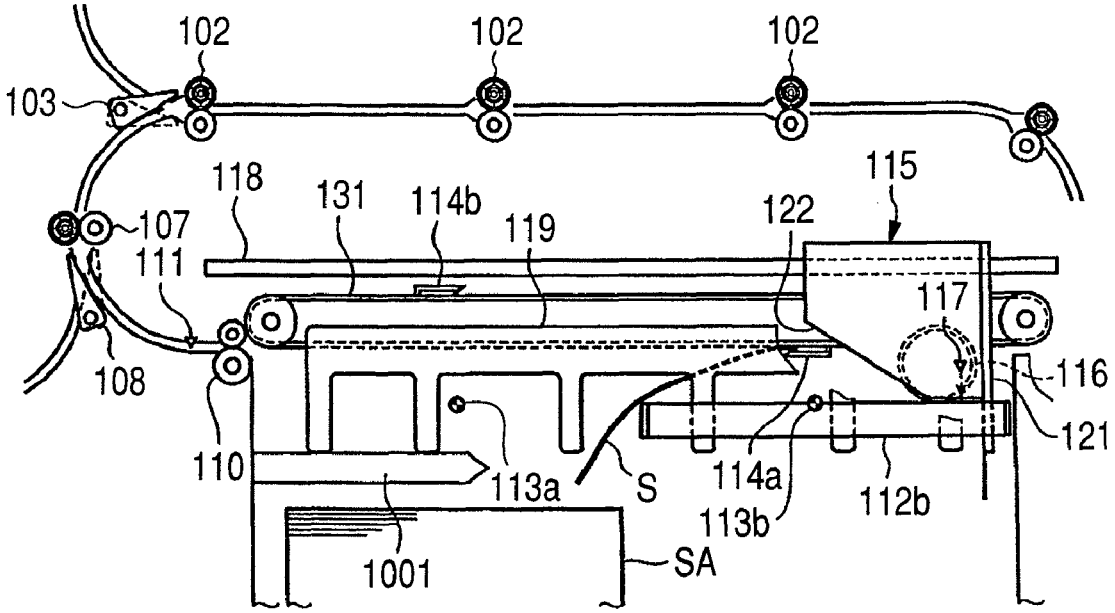
FIGS. 10A and 10B are second views illustrating sheet stacking operations for the second stacker tray provided in the stacker.

Thus, the gripper 114*a*, gripping the leading end of the sheet, moves integrally with the driving belt 131, whereby the sheet S, after passing above the first stacker tray 112*a*, is conveyed as illustrated in FIG. 10A. Subsequently, when the gripper 114*a* passes the tapered portion 122 of the sheet guide unit 115, it is urged by the tapered portion 122 toward the stacker tray 112*b* whereby the sheet S moves along the tapered portion 122 and is guided to the rollet belt 116.

Figure 10B:
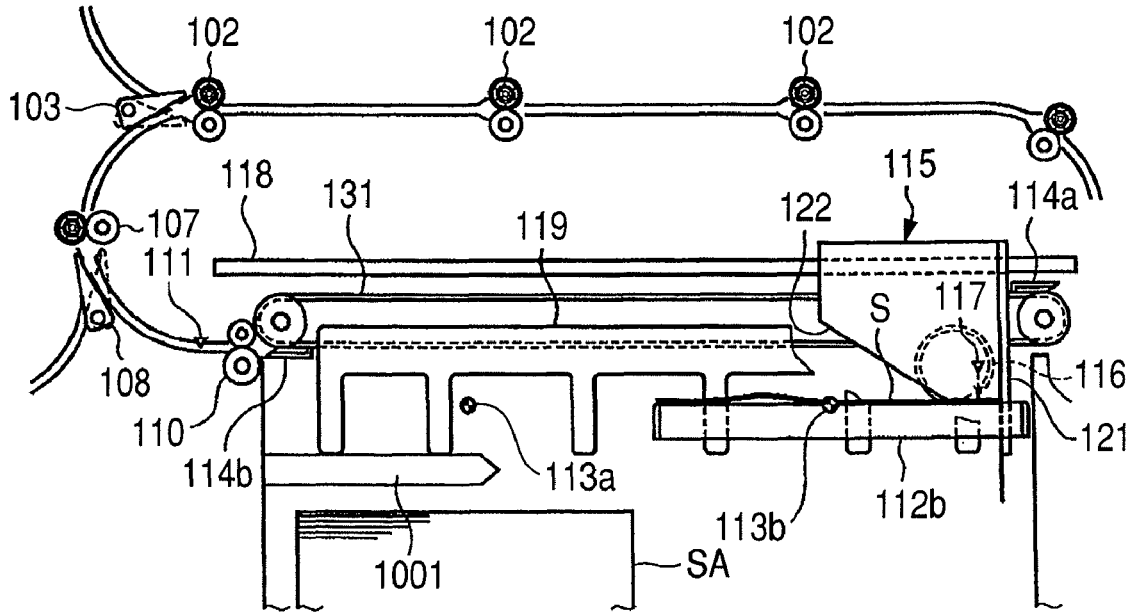

Thereafter, the sheet S is conveyed by the rollet belt 116 until the leading end thereof impinges on the stopper 121 as illustrated in FIG. 10B, and is stacked, in a state aligned by the leading end, onto the second stacker tray 112*b*. After such stacking of the sheet S, an alignment in the width direction is executed by the alignment plate 119. The alignment plate 119, after the alignment of the sheet S, is retracted by a predetermined amount in the width direction, and awaits the conveyance of a new sheet.

Thereafter, the stacker control portion 210 circulates the driving belt 131 to discharge and convey sheets alternately by the two grippers 114*a*, 114*b* thereby stacking the sheets in succession on the second stacker tray 112*b*.

In this state, the stacker control portion 210 constantly monitors the upper surface of the sheets S stacked on the second stacker tray 112*b*, by the sheet surface detection sensor 117. When the distance between the sheet guide unit 115 (rollet belt 116 thereof) and the upper surface of the stacked sheets becomes smaller than a predetermined amount, the stacker control portion 210 lowers the second stacker tray 112*b* by a predetermined amount by the second stacker tray elevating motor 152*b*.

Such control enables to increase the distance between the sheet guide unit 115 (rollet belt 116 thereof) and the upper surface of the stacked sheets, thereby enabling stacking of a next sheet. By the repetition of these operations, the sheets S are stacked in succession on the second stacker tray 112*b* and the all the sheets S are eventually stacked on the second stacker tray 112*b*.

Depending on the number of sheets in the job, the second stacker tray 112*b* may eventually become fully loaded. The full loaded state of the second stacker tray 112*b* can be detected by counting, in the stacker control portion 210 (FIG. 2), the detection signal of the timing sensor 111 indicating the detection of the sheet S discharged from the paired discharge rollers 110. Otherwise, it can be detected by detecting, by the stacker control portion 210 (FIG. 2), the lowered position of the second stacker tray 112*b* and the position of the uppermost sheet.

Figure 11:
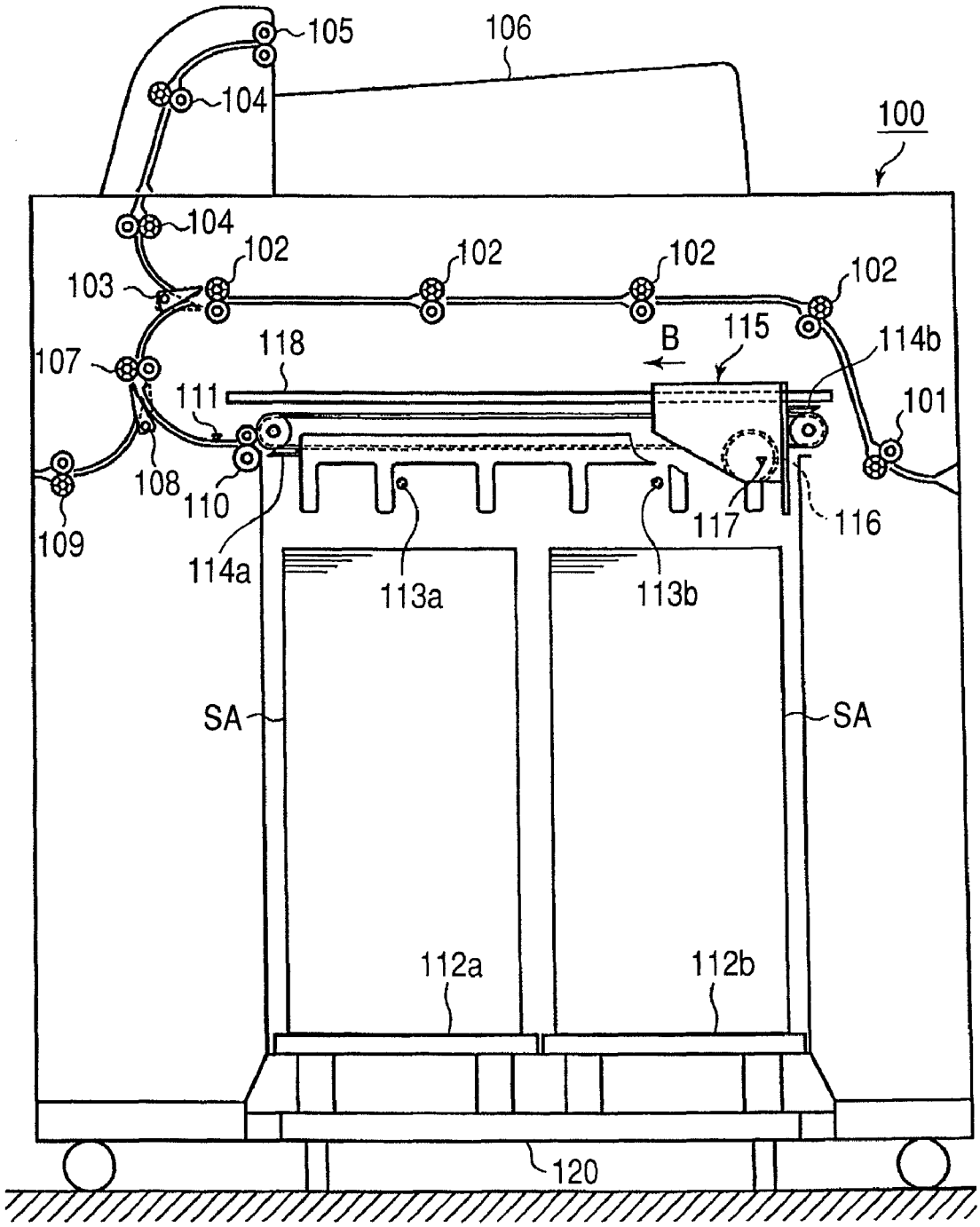
FIG. 11 is a view illustrating a state where the second stacker tray is fully stacked and the stacked sheet bundle is placed, together with the second stacker tray, on a dolly.

When the fully loaded state of the second stacker tray 112*b* is detected by such construction, the stacker control portion 210 lowers the second stacker tray 112*b* and places the sheets, together with the second stacker tray, on the dolly 120 as illustrated in FIG. 11. Thereafter, the guide unit 115 moves in a direction indicated by an arrow B and waits on the first stacker tray 112*a*.

The first and second stacker trays 112*a*, 112*b* are supported by an unillustrated support member which can be elevated or lowered, and the first and second stacker trays 112*a*, 112*b* are transferred to the dolly 120 by a descent of the support member to a position lower than the supporting surface of the dolly 120.

Figure 12:
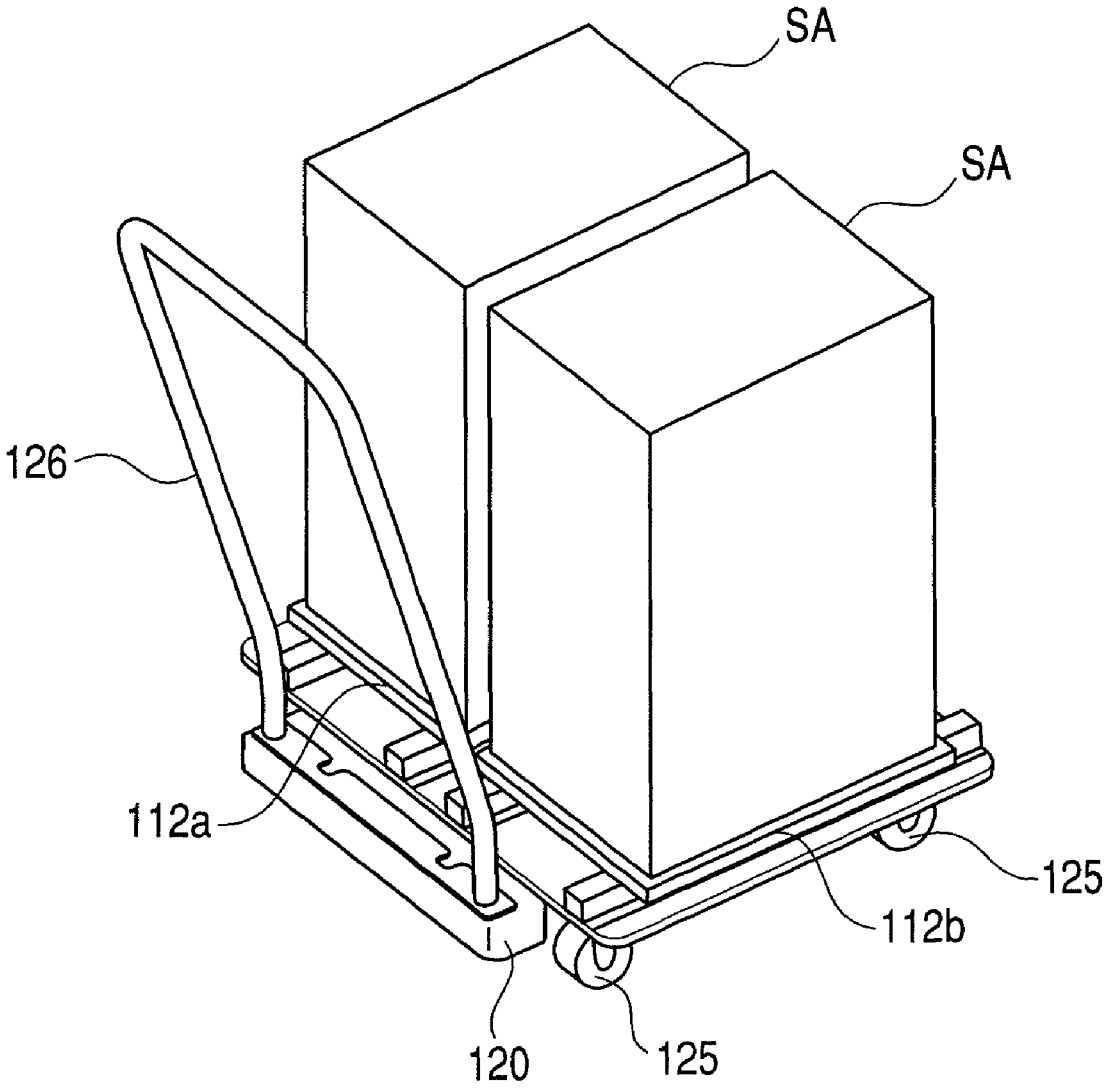
FIG. 12 is a perspective view of the dolly in a state where the sheet bundle is stacked.

The dolly 120 is equipped with castors 125 and a handle 126 as illustrated in FIG. 12, in order to carry out the first and second stacker trays 112*a*, 112*b*, respectively fully loaded with the sheets, from the stacker. By a displacement with the handle 126, the sheet bundle SA of a large amount can be moved, together with the first and second stacker trays, at a time and in an easy manner.

After the stacker trays 112*a*, 112*b* are transferred to the dolly 120, the stacker trays 112*a*, 112*b* are fixed by a fixing member such as an unillustrated pin, provided on an upper surface of the dolly 120. Then, after the dolly 120 loaded with the sheet bundle SA of a large amount is extracted from the stacker 100, the sheet bundles stacked on the stacker trays 112*a*, 112*b* are removed.

The stacker 100 is stopped after the dolly 120 is thus extracted and until the dolly 120 is set again into the stacker 100. Then, after the sheets S are removed, the dolly 120 and the first and second stacker trays 112*a*, 112*b* are fitted into the stacker 100. It is also possible to prepare a spare dolly and spare stacker trays 112, and to set these in the stacker 100 for enabling operation of the stacker 100.

When the dolly 120 is set in the stacker 100, the setting is detected by a dolly set sensor 181 (cf. FIG. 3), and, based on its detection signal, the stacker control portion 210 elevates the first and second stacker trays 112*a*, 112*b*. Thus the first and second stacker trays 112*a*, 112*b* return to the already described state in FIG. 4, thereby enabling stacking of new sheets.

In the present exemplary embodiment, a large-sized sheet such as of A3-size can be discharged and stacked on the first and second stacker trays 112*a*, 112*b*. In the following, an operation of stacking a large-sized sheet on the first and second stacker trays 112*a*, 112*b*.

Figure 13:
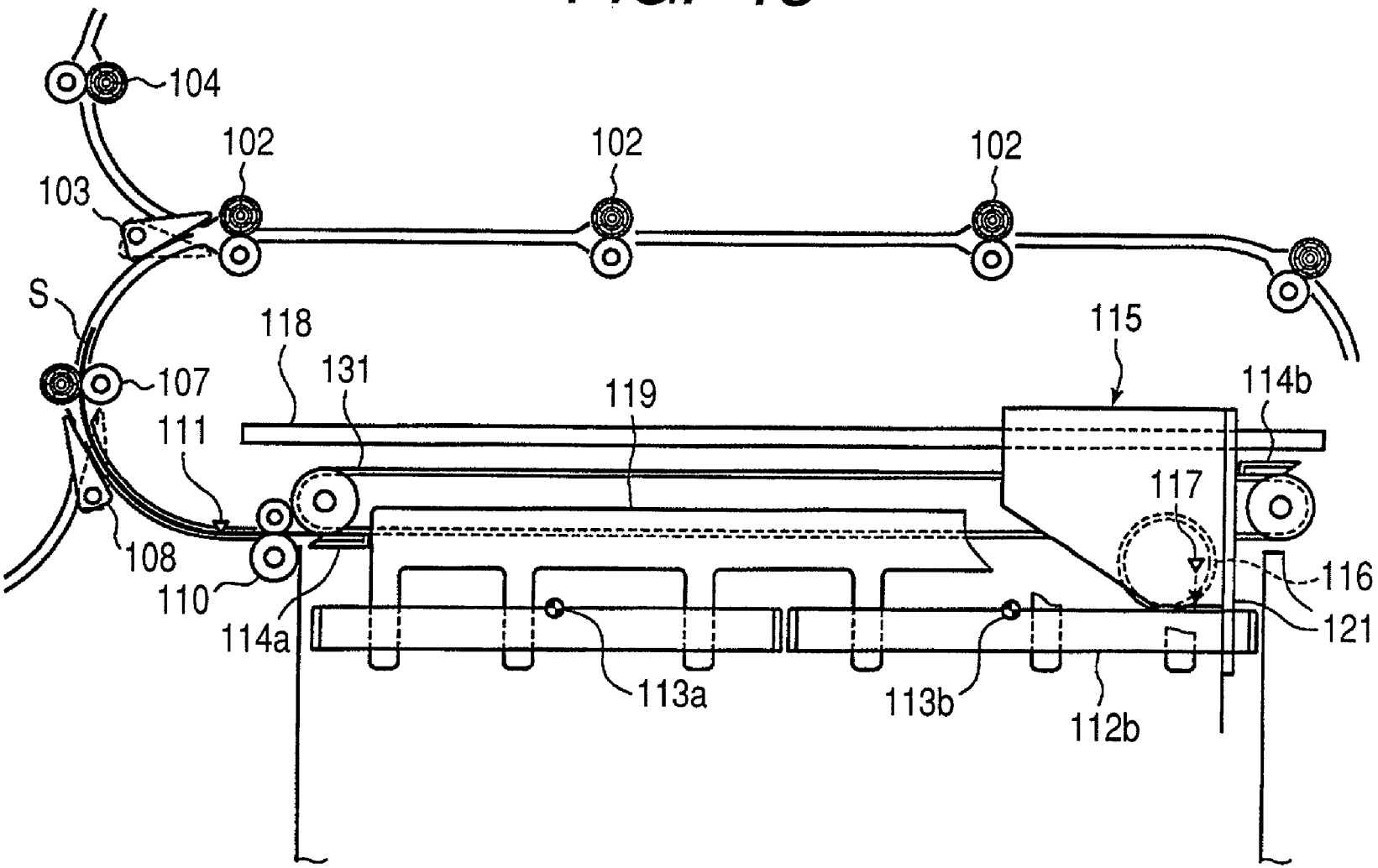
FIG. 13 is a first view illustrating operation of stacking a large-sized sheet on first and second stacker trays.

In such case, the stacker control portion 210 simultaneously drive the stacker tray elevating motors 152*a*, 152*b* thereby moving the first and second stacker trays 112*a*, 112*b* to the respective home positions, as illustrated in FIG. 13. Upon such movement of the first and second stacker trays 112*a*, 112*b* to the respective home positions, the sheet stacking surfaces thereof are in a same position as described above.

Figure 14A:
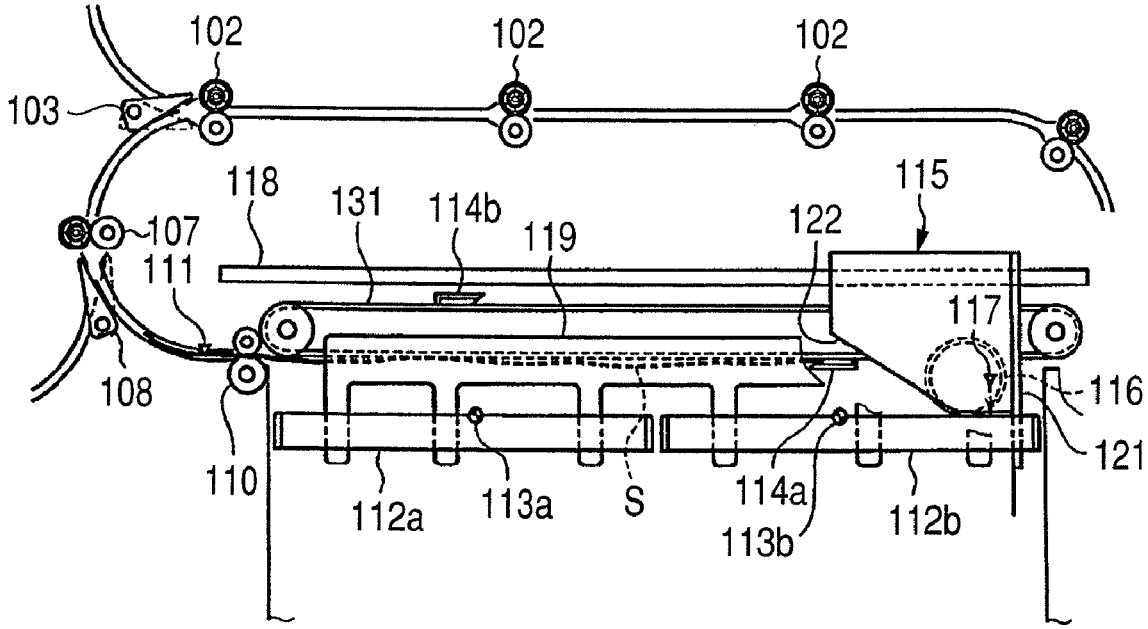
FIGS. 14A and 14B are second views illustrating operation of stacking the large-sized sheet on the first and second stacker trays.
Figure 14B:
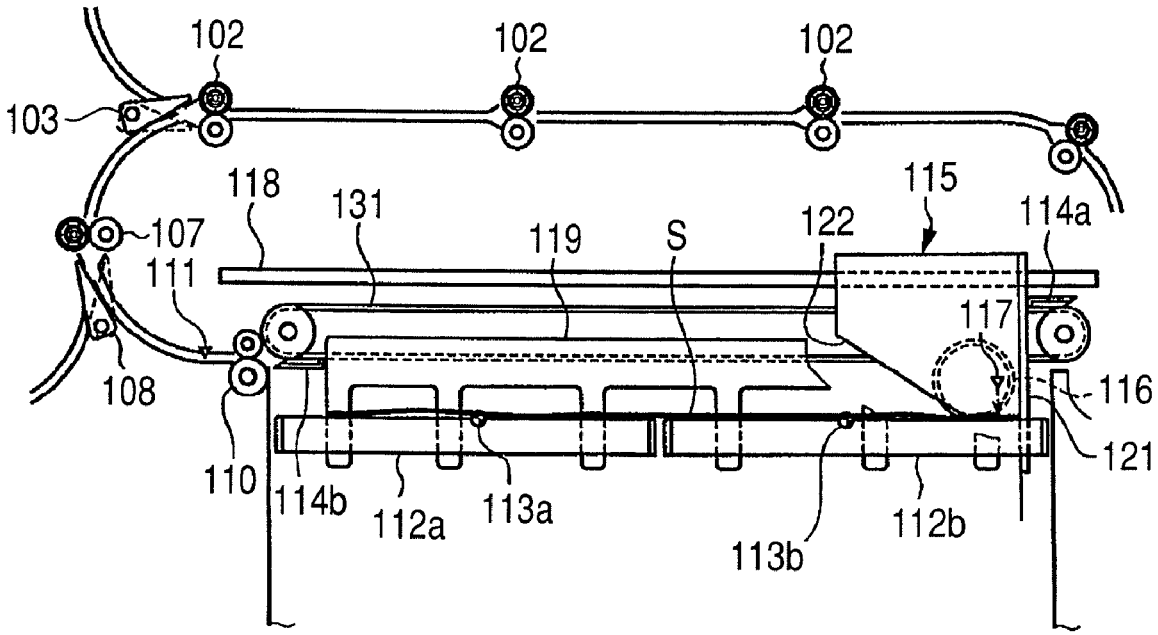

Also the stacker control portion 210, before the sheet S is conveyed, moves the guide unit 115 in a direction of an arrow A in FIG. 4, to a stand-by position at the downstream side, in the sheet discharge direction, of the second stacker tray 112*b*, as illustrated in FIGS. 14A and 14B.

When the sheet S from the main body 901 of the image forming apparatus is conveyed by the above-described sheet conveying control to the paired discharge rollers 110, the passing of the leading end of the sheet is detected by the timing sensor 111. Thereafter, the sheet is gripped by the gripper 114*a* in a stopped stand-by position, and the driving belt 131 is driven counterclockwise according to the timing of detection of the leading end of the sheet by the timing sensor 111.

Thus, the gripper 114*a*, gripping the leading end of the sheet, moves integrally with the driving belt 131, whereby the sheet S, after passing above the first stacker tray 112*a*, is conveyed as illustrated in FIG. 14A. Subsequently, when the gripper 114*a* passes the tapered portion 122 of the sheet guide unit 115, it is urged by the tapered portion 122 toward the stacker tray 112*b* whereby the sheet S moves along the tapered portion 122 and is guided to the roller belt 116.

Thereafter, the sheet S is conveyed by the roller belt 116 until the leading end thereof impinges on the leading end stopper 121 as illustrated in FIG. 14B, and is stacked, in a state aligned by the leading end, bridging over the first and second stacker trays 112*a*, 112*b*. After such stacking of the sheet S, an alignment in the width direction is executed by the alignment plate 119. The alignment plate 119, after the alignment of the sheet S, is retracted by a predetermined amount in the width direction, and awaits the conveyance of a new sheet.

Thereafter, the stacker control portion 210 circulates the driving belt 131 to discharge and convey sheets alternately by the two grippers 114*a*, 114*b* thereby stacking the sheet S in succession bridging over the first and second stacker trays 112*a*, 112*b*.

In this state, the stacker control portion 210 constantly monitors the upper surface of the sheets S stacked bridging over the first and second stacker trays 112*a*, 112*b*, by the sheet surface detection sensor 117. When the distance between the sheet guide unit 115 and the upper surface of the stacked sheets becomes smaller than a predetermined amount, the stacker control portion 210 lowers the first and second stacker trays 112*a*, 112*b* by a predetermined amount by the first and second stacker tray elevating motors 152*a*, 152*b*.

Such control enables to increase the distance between the sheet guide unit 115 and the upper surface of the stacked sheets, thereby enabling stacking of a next sheet. By the repetition of these operations, the sheets S are stacked in succession bridging over the first and second stacker trays 112*a*, 112*b*.

By such discharge of the sheets in succession, the first and second stacker trays 112*a*, 112*b* eventually become fully loaded. The full loaded state of the first and second stacker trays 112*a*, 112*b* can be detected by counting, in the stacker control portion 210 (FIG. 2), the detection signal of the timing sensor 111 indicating the detection of the sheet S discharged from the paired discharge rollers 110. Otherwise, it can be detected by detecting, by the stacker control portion 210 (FIG. 2), the lowered position of the first and second stacker trays 112*a*, 112*b* and the position of the uppermost sheet.

Figure 15:
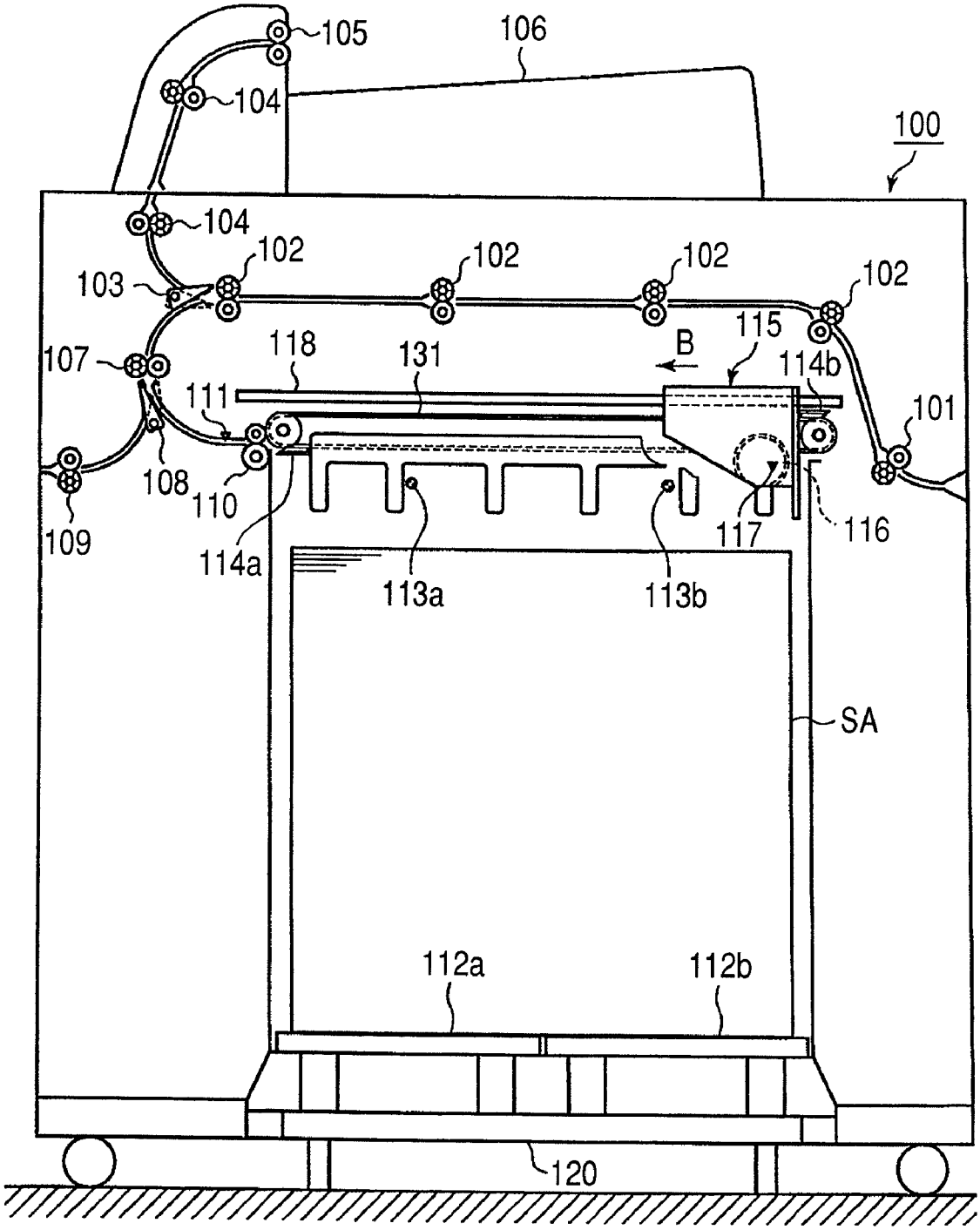
FIG. 15 is a view illustrating a state where the first and second stacker tray is fully stacked and the stacked sheet bundle is placed, together with the first and second stacker trays, on a dolly.
Figure 16:
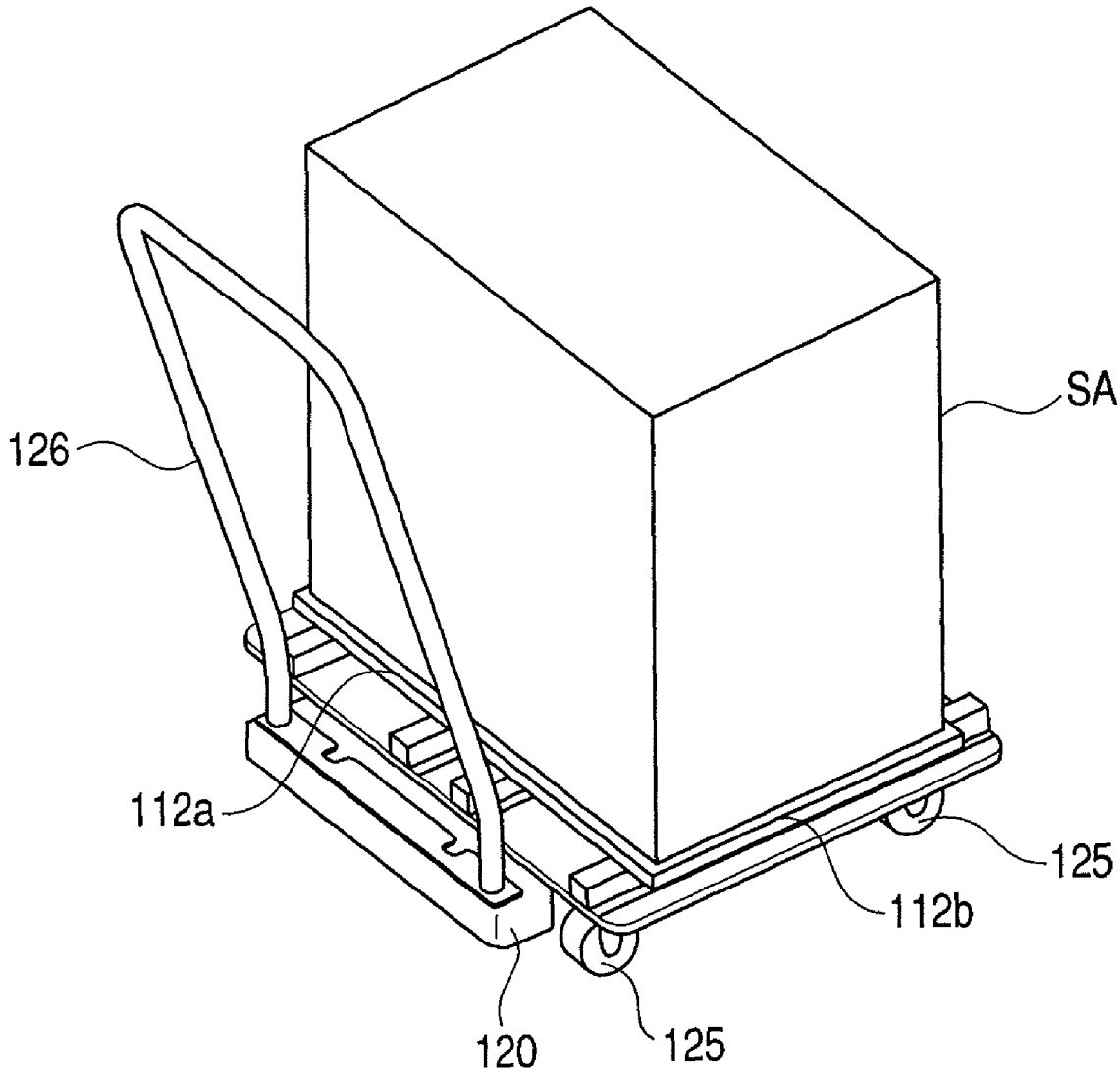
FIG. 16 is a perspective view of the dolly in a state where the sheet bundle is stacked.

When the fully loaded state of the first and second stacker trays 112*a*, 112*b* is detected by such construction, the stacker control portion 210 lowers the first and second stacker trays 112*a*, 112*b* at the same time. Thus, as illustrated in FIGS. 15 and 16, the first and second stacker trays 112*a*, 112*b* are transferred to the dolly 120.

In the present exemplary embodiment, as already described above, small-sized sheet such as of A4-size are stacked in succession in the first and second stacker trays 112*a*, 112*b*. For example, in the case that the sheets are stacked in the order of the first stacker tray 112*a* and the second stacker tray 112*b*, the sheet S passes above the first stacker tray 112*a* and is then conveyed as illustrated in FIG. 10A.

When the sheet S passes above the first stacker tray 112*a*, a hanging-down or a flapping of the trailing end of the conveyed sheet may cause a destruction of the already stacked sheet bundle or a stain or a damage to the sheet by the friction.

In the present exemplary embodiment, therefore, in the case that the sheet stacking is selected in the second stacker tray 112*b*, a sheet guide 1001 is provided to be capable of projecting upward from the sheets SA already stacked on the first stacker tray 112*a*, as illustrated in FIGS. 8 to 10B.

The sheet guide 1001, which is a guide member, is so provided as to extend from an upstream side end, in the sheet conveying direction, of the first stacker tray 112*a*, toward the downstream side. As the sheet discharging speed of the paired discharge rollers 110 is selected slightly higher than the conveying speed of the grippers 114*a*, 114*b* in order that the leading end of the sheet S is not detached from the gripping portion of the gripper 114*a* or 114*b*, a bend is formed in the sheet S when passing through the paired discharge rollers 110. When the sheet S is released from the paired discharge rollers 110, the force accumulated by such bending is released, whereby the trailing end of the sheet causes a strong downward displacement. It is possible, by covering the upstream side end portion of the sheets SA stacked on the first stacker tray 112*a*, to prevent a roll-up of the upstream side end portion of the stacked sheets SA caused by a collision with the sheet S passing above the first stacker tray 112*a*. It is also possible to prevent a destruction of the sheet bundle SA already stacked on the first stacker tray 112*a* or a stain or a damage to the sheet (particularly sheet having images on both sides) by the friction by a hanging-down or a flapping of the trailing end of the conveyed sheet.

The sheet guide 1001 is provided retractably upward from the main body 100A of the stacker. The sheet guide 1001 projects to an upper portion of the first stacker tray 112*a* in case of sheet stacking on the second stacker tray 112*b*. Otherwise the sheet guide 1001 is retracted inside the main body 100A of the stacker. In such projected state of the sheet guide 1001, when the sheet is conveyed to the second stacker tray 112*b*, the trailing end of the sheet is guided on the upper surface of the sheet guide 1001. Thus the trailing end of the sheet, passing above the first stacker tray, can be prevented from contacting the sheets SA stacked on the first stacker tray 112*a*.

Figure 17:
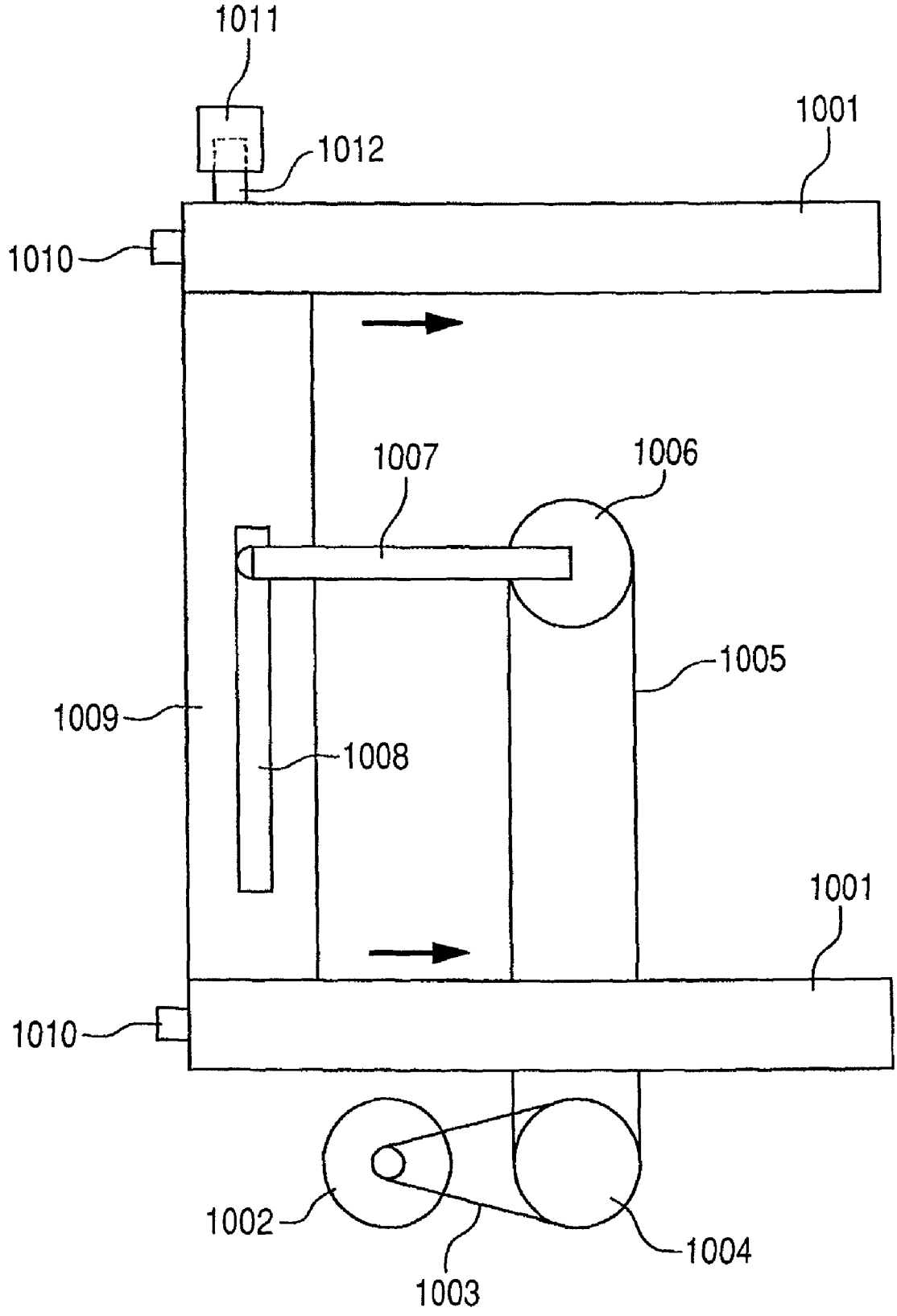
FIG. 17 is a view illustrating the construction of a sheet guide provided in the stacker, and a mechanism for driving the sheet guide.

The sheet guide 1001 is provided, as illustrated in FIG. 17, in two (or plural) units in the width direction perpendicular to the sheet conveying direction. The two sheet guides 1001 are mounted, as illustrated in FIG. 17, on shafts 1010 movably in the sheet discharge direction indicated by an arrow and are mounted on both ends of a connecting member 1009. The connecting member 1009 is provided with a groove 1008 extending in the width direction, and a sheet guide moving lever 1007, fixed at an end thereof to a gear 1006, is inserted at the other end into the groove 1008. The sheet guide 1001, as being mounted on a plane of a frame member of the main body 100A of the stacker, perpendicular to the sheet conveying direction and on upstream side in the sheet conveying direction, requires only a small mounting space in the width direction perpendicular to the sheet conveying direction, and does not require a separate structural member.

The gear 1006 integral with the sheet guide moving lever 1007 is linked, by a belt 1005, with a two-stage gear 1004, and such two-stage gear 1004 is connected with a sheet guide motor 1002 through a belt 1003.

In FIG. 17, a home position sensor 1011 is illustrated. The home position sensor 1011, by detecting a flag 1012 provided on the sheet guide 1001, determines whether the sheet guide 1001 is in the home position.

Figure 18:
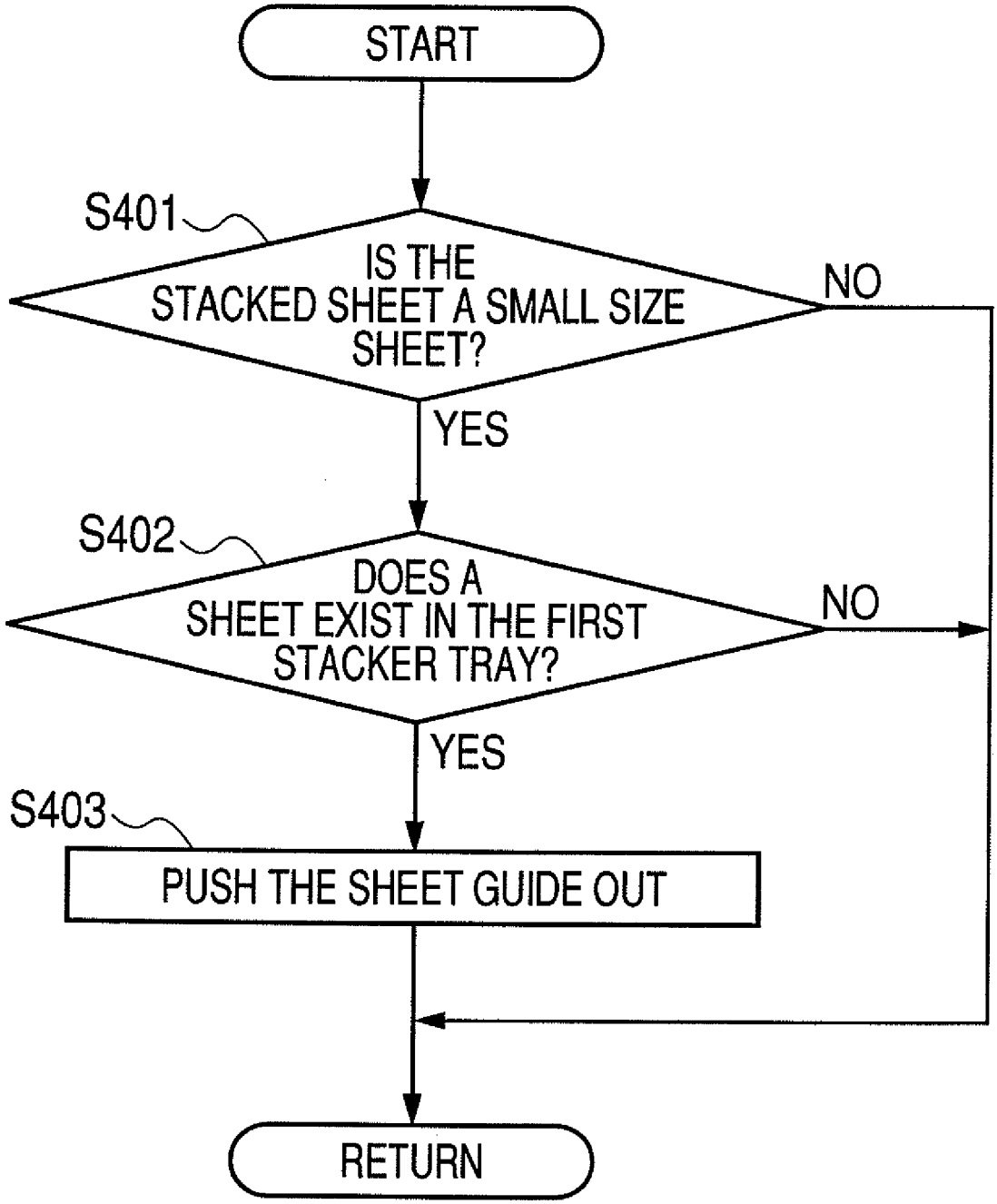
FIG. 18 is a flow chart describing a projection control for the sheet guide.

In the following, a projection control for such sheet guide 1001 will be described with reference to a flow chart in FIG. 18.

At first, the stacker control portion 210 discriminates whether the sheet discharged and stacked on the stacker tray is a small size such as A-4 size. Thus it is identified whether the discharged or stacked sheet is a small size such as A-4 size (S401). In the case that the discharged or stacked sheet is identified as a small size such as A-4 size (Y in S401), it is then discriminated whether sheets are present on the first stacker tray 112*a* (S402).

Figure 19:
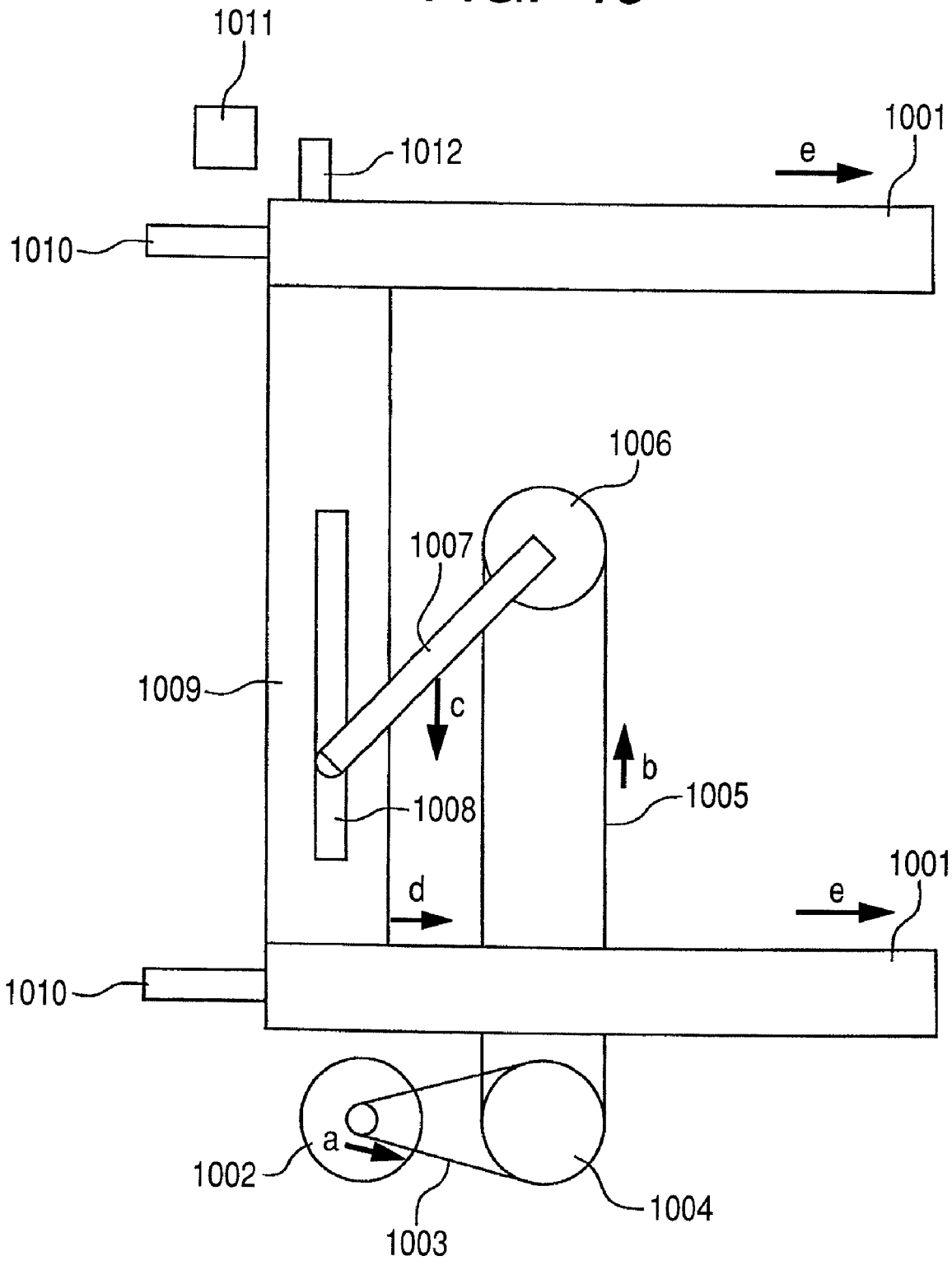
FIG. 19 is a view illustrating a projecting operation of the sheet guide.

In the case that the sheets are present on the first stacker tray 112*a* (Y in S402), the stacker control portion 210 rotates the sheet guide motor 1002 in a direction of an arrow a, as illustrated in FIG. 19 In response to the rotation of the sheet guide motor 1002 in the direction of arrow a, the two-stage gear 1004 is rotated by the belt 1003 and the rotation of the two-stage gear 1004 displaces the belt 1005 in a direction of an arrow b.

Such displacement of the belt 1005 causes a displacement of the sheet guide moving lever 1007, integral with the gear 1006, in a direction of an arrow c, whereby the connecting member 1009 having the groove 1008 is moved in a direction of an arrow d. Thus, the sheet guides 1001 mounted on the both ends of the connecting member 1009 are displaced in a direction of an arrow e. Such displacement of the sheet guide 1001 in the direction of arrow e causes the sheet guide 1001 to project above the sheet bundle stacked on the first stacker tray 112*a* (S403).

Such projection of the sheet guide 1001 enables, when the sheet passes above the first stacker tray for stacking on the second stacker tray, to prevent contact of the sheet with the sheet bundle on the first stacker tray. It is thus possible to prevent the sheets, already stacked on the first stacker tray, to be moved together with the sheet passing above the first stacker tray. As a result, a destruction of the sheets already stacked on the first stacker tray 112*a* or a stain or a damage to the sheet by the friction can be prevented.

The sheet guide 1001 has a variable projecting amount of projection, according to the sheet size (length in the sheet discharge direction) of the sheets already stacked on the first stacker tray 112*a*, and the projecting amount can be regulated by the sheet guide motor 1002. For example by a projection of the sheet guide 1001 to the downstream side end portion in the sheet discharge direction, according to the size of the sheets already stacked on the first stacker tray 112*a*, the rubbing of the image on the upper surface of the sheet can also be avoided. Also by a further projection of the sheet guide 1001, it can serve as the guide for sheet discharge to the second stacker tray 112*b* even when the sheet is absent on the first stacker tray 112*a*.

Such projection of the sheet guide 1001, in case of sheet conveying on the second stacker tray 112*b*, enables to prevent the sheets, already stacked in the first stacker tray, to be moved together with the conveyed sheet, thus enabling to stack the sheet without a destruction of the stacked sheet bundle. Also such construction enables sheet stacking without causing a stain or a damage to the sheet by the friction.

In the following, a second exemplary embodiment of the present invention will be described.

Figure 20:
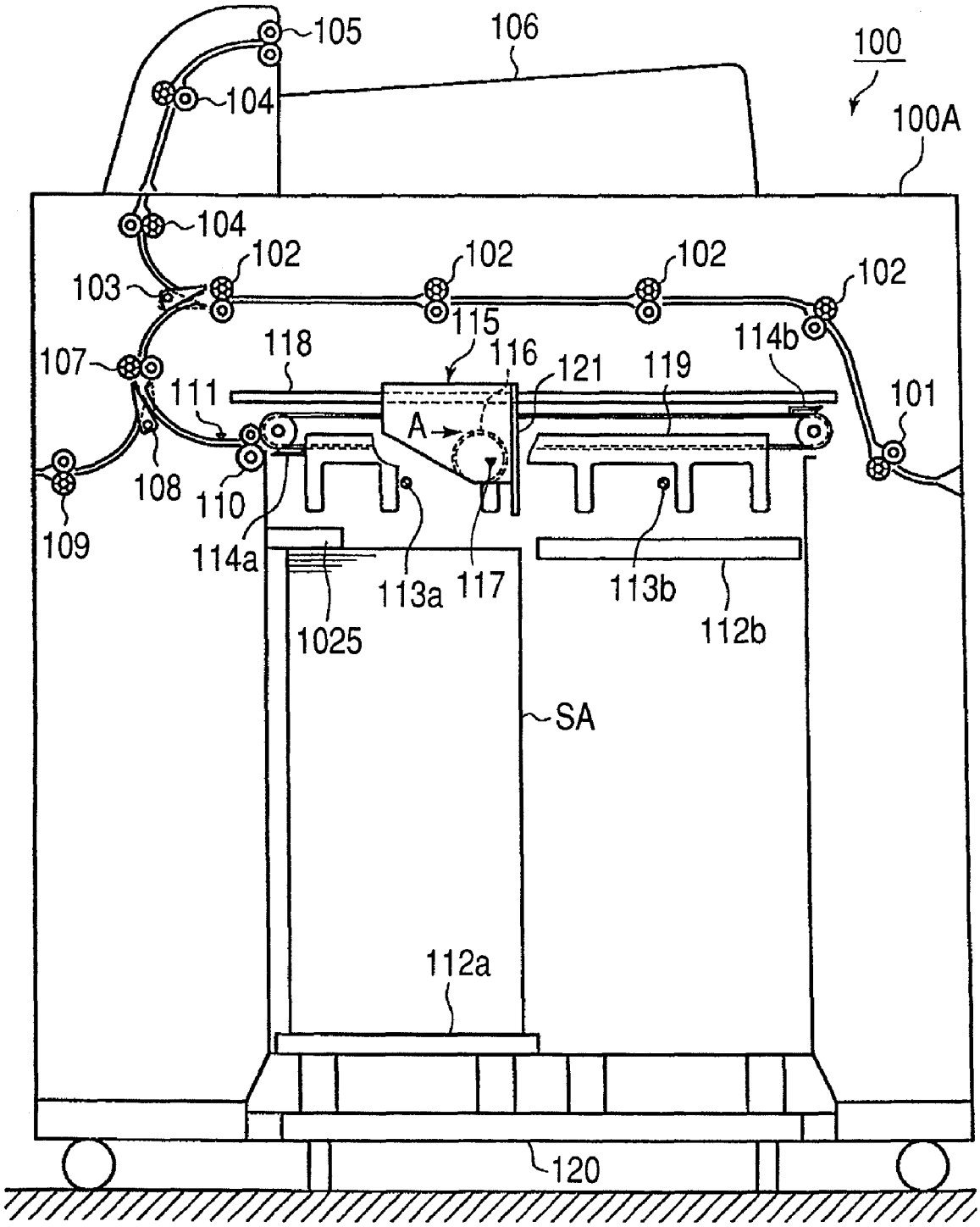
FIG. 20 is a view illustrating the construction of a stacker, constituting a sheet stacking apparatus in a second exemplary embodiment of the present invention.

FIG. 20 is a view illustrating the construction of a stacker, constituting a sheet stacking apparatus of the present exemplary embodiment. In FIG. 20, symbols same as those in FIG. 4 as described above represent same or equivalent components.

In FIG. 20, illustrated is a sheet hold member 1025 constituting an example of the hold member. When the sheet is stacked on the second stacker tray 112*b*, the sheets SA stacked on the first stacker tray 112*a* is held down from the upper portion of the first stacker tray by the sheet hold member 1025.

The sheet hold member 1025 is provided pivotably in the main body 100A of the stacker an up-down direction, and, when the sheet is conveyed to the second stacker tray 112*b*, it is pivoted downwards to project above the first stacker tray thereby holding down the sheet bundle SA on the first stacker tray from the upper portion of the first stacker tray.

Such hold of the sheets SA by the sheet hold member 1025 prevents, when the trailing end of the sheet conveyed toward the second stacker tray 112*b* touches the sheets SA stacked on the first stacker tray, the sheets SA to be brought together.

Figure 21:
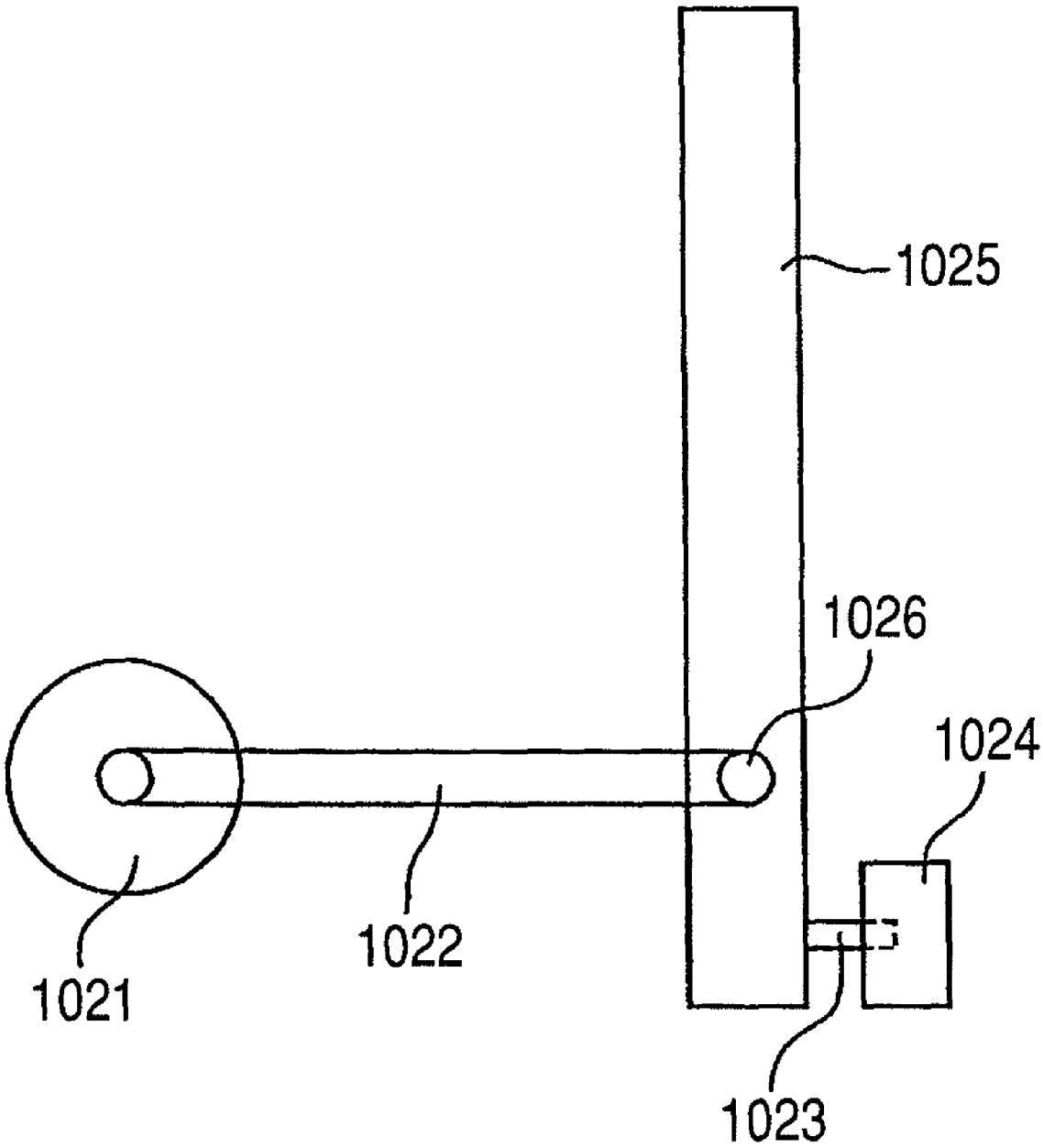
FIG. 21 is a view illustrating a driving portion for a sheet hold member provided in the stacker.

FIG. 21 is a view illustrating the construction of a driving portion for driving the sheet hold member 1025, in which the sheet hold member 1025 is provided pivotably in the up-down direction by a rotary shaft 1026 on an unillustrated frame provided in the main body of the stacker.

The shaft 1026 is connected by a belt 1022 to a sheet hold motor 1021. In FIG. 21, illustrated is a home position sensor 1024. The home position sensor 1024 detects a flag 1023 provided in the sheet hold member 1025 to detect whether the sheet hold member 1025 is in a home position retracted from the upper portion of the first stacker tray.

Figure 22:
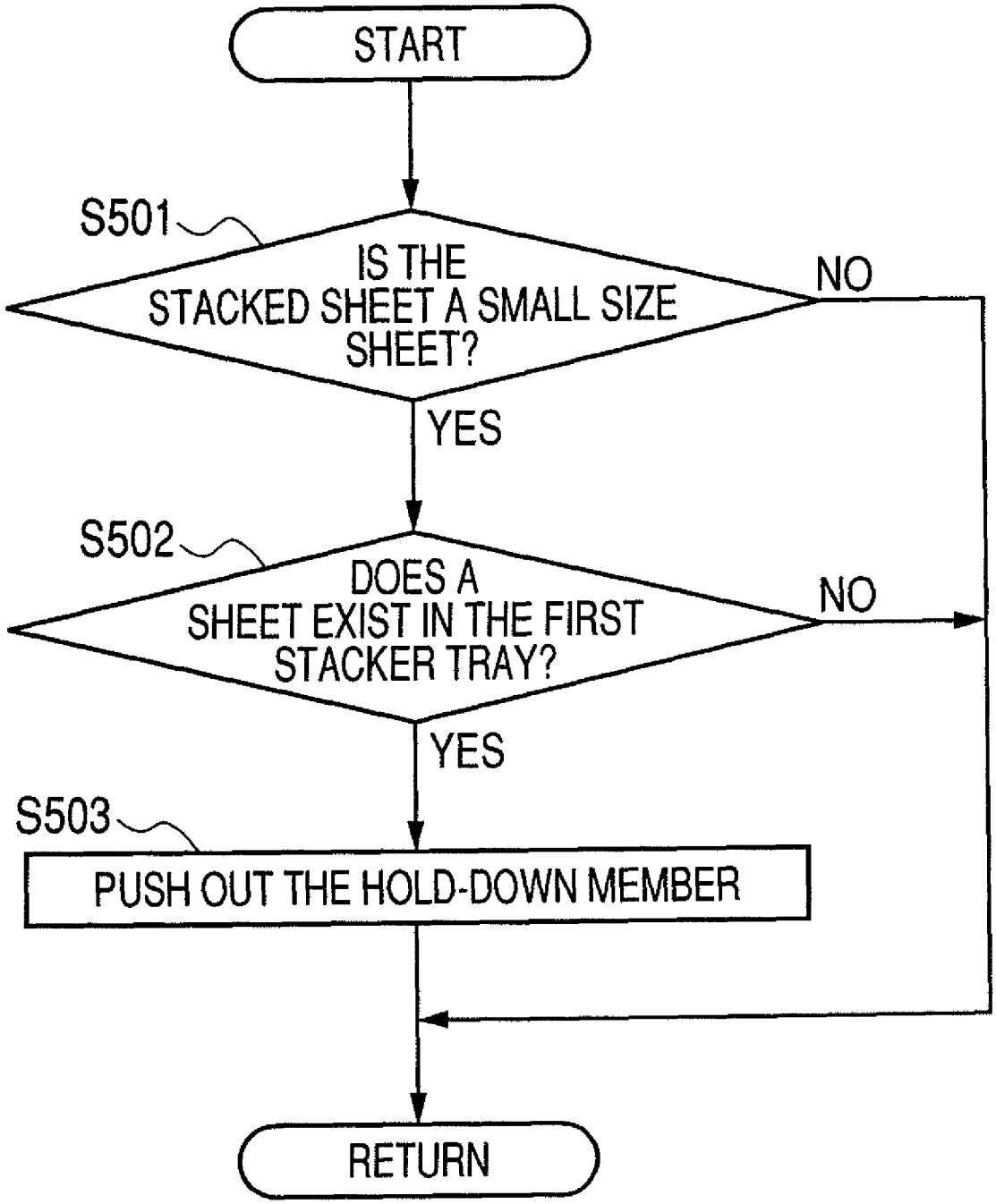
FIG. 22 is a flow chart describing a pivoting (projecting) control for the sheet hold member.

In the following, a pivoting (projection) control for the sheet hold member 1025 will be described with reference to a flow chart in FIG. 22.

At first, the stacker control portion 210 discriminates whether the sheet discharged and stacked on the stacker tray is a small size such as A-4 size. Thus it is identified whether the discharged or stacked sheet is a small size such as A-4 size (S501). In the case that the discharged or stacked sheet is identified as a small size such as A-4 size (Y in S501), it is then discriminated whether sheets are present on the first stacker tray 112*a* (S502).

Figure 23:
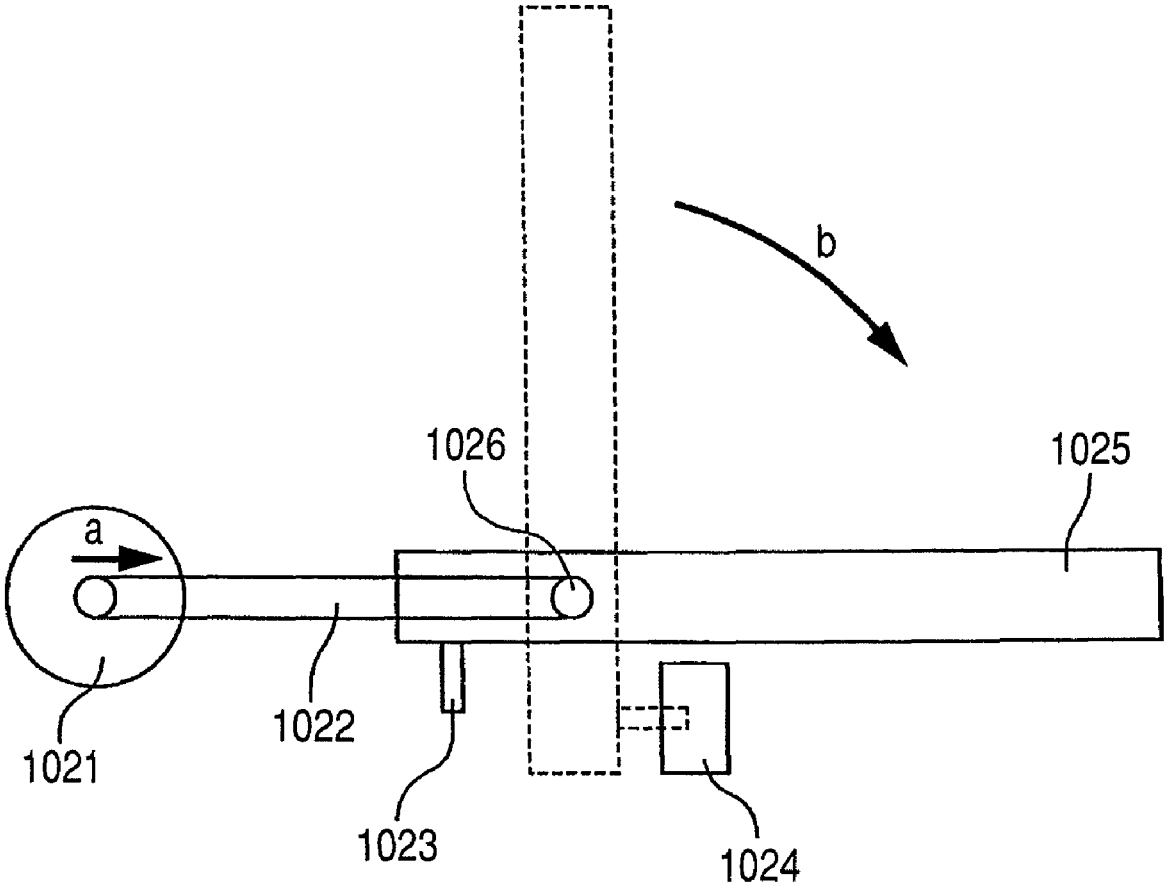
FIG. 23 is a view illustrating a rejecting operation of the sheet hold member.

In the case that the sheets are present on the first stacker tray 112*a* (Y in S502), the stacker control portion 210 rotates the sheet hold motor 1021 in a direction of an arrow a, as illustrated in FIG. 23. In response to the rotation of the sheet hold motor 1021, the rotary shaft 1026 is rotated by the belt 1022

Also by such rotation of the rotary shaft 1026, the sheet hold member 1025 pivots downwards from the broken-lined home position about the rotary shaft 1026, and projects to a position for holding down, from the upper portion of the first stacker tray 112*a*, the sheets SA stacked on the first stacker tray 112*a* (S503). Thus the sheet bundle SA already stacked on the first stacker tray 112*a* is held down by the sheet hold member 1025.

Such hold by the sheet hold member 1025 enables, when the sheet passes above the first stacker tray for stacking on the second stacker tray and contacts the sheets on the first stacker tray, to prevent that the sheet bundle is brought together and thus destructed. Also even in the absence of contact, the stacked state of the sheets on the first stacker tray is not disturbed by an air pressure generated when the sheet to be stacked on the second stacker tray passes above the first stacker tray.

Thus, when the sheet is conveyed to the second stacker tray 112*b*, the sheet hold member 1025 is made to project for holding down the sheets stacked on the first stacker tray, thereby preventing that the stacked sheets are brought together with the sheet passing above the first stacker tray. Therefore, the sheet can be stacked on the second stacker tray 112*b* without destructing the sheet bundle stacked on the first stacker tray. Also such construction enables to protect the sheets already stacked on the stacker tray 112*a* from destruction by a simple structure.

In the present exemplary embodiment, the sheet hold member 1025 is provided in one unit, but it may be provided in two or more units in the width direction, in order to improve the effect of preventing destruction of the already stacked sheets. The sheet hold member 1025 is separated off from the sheet bundle SA when the first stacker tray 112*a* becomes fully loaded and is transferred to the dolly 120 as described above. In this manner, the sheet bundle SA is prevented from destruction when the dolly 120 is taken out.

In the foregoing first and second exemplary embodiments, there has been described a construction in which the stacker control portion 210 is mounted on the stacker 100 and executes the drive control of the entire stacker by information exchange with the CPU circuit portion 206 in the main body 901 of the image forming apparatus. It is naturally possible to obtain similar effects by providing the stacker control portion 210, integrally with the CPU circuit portion 206, in the controller 960 of the main body 901 of the image forming apparatus, and by controlling the stacker 100 directly from the controller 960.

Also the stacker has been explained to be provided with two stacker trays, but may also have three or more stacker trays. Also as the sheet conveying portion, there has been described a construction of gripping the leading end of the sheet by a gripper, but a construction having an air suction apparatus on the driving belt instead of the gripper may be adopted for conveying the sheet by an air suction. Furthermore, the sheet conveying portion may be constructed by providing the driving belt with an electrostatic attraction apparatus for conveying the sheet by an electrostatic attraction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2006-354221, filed Dec. 28, 2006 and No. 2007-326092, filed Dec. 18, 2007 which are hereby incorporated by reference herein in their entirety.

What is claimed is:

1. A sheet stacking apparatus comprising:

a sheet conveying portion which conveys a sheet;

a first sheet stacking portion which stacks the sheet conveyed by the sheet conveying portion;

a second sheet stacking portion, disposed downstream of the first sheet stacking portion in the sheet conveying direction, which stacks the sheet conveyed by the sheet conveying portion; and a guide member, disposed above the first sheet stacking portion to downstream project from an upstream end of the first sheet stacking portion in the sheet conveying direction, wherein the sheet conveying portion conveys the sheet to one of the first and the second sheet stacking portions selectively, and wherein when the sheet conveying portion conveys the sheet to the second sheet stacking portion, said guide member guides to the second sheet stacking portion an upstream end of the sheet in the sheet conveying direction, the sheet being conveyed by the sheet conveying portion while the sheet conveying portion holds a downstream end of the sheet in the sheet conveying direction.

2. A sheet stacking apparatus according to claim 1, wherein the guide member is provided retractably from an upper portion of the first sheet stacking portion.

3. A sheet stacking apparatus according to claim 1, wherein an amount of projection of the guide member is variable depending on a length of the sheet , in the sheet conveying direction, stacked on the first sheet stacking portion.

4. An image forming apparatus, comprising:

an image forming portion for forming an image on a sheet; and a sheet stacking apparatus according to claim 1, for stacking a sheet after image formation.

5. A sheet stacking apparatus comprising:

a sheet conveying portion which conveys a sheet;

a first sheet stacking portion which stacks the sheet conveyed by the sheet conveying portion;

a second sheet stacking portion, disposed downstream of the first sheet stacking portion in the sheet conveying direction, which stacks the sheet conveyed by the sheet conveying portion; and a guide member , disposed above the first sheet stacking portion to downstream project from a plane of a frame member disposed upstream in the sheet conveying direction, wherein the sheet conveying portion conveys the sheet to one of the first and the second sheet stacking portions selectively, and wherein when the sheet conveying portion conveys the sheet to the second sheet stacking portion, said guide member guides to the second sheet stacking portion an upstream end of the sheet in the sheet conveying direction, the sheet being conveyed by the sheet conveying portion while the sheet conveying portion holds a downstream end of the sheet in the sheet conveying direction.

6. A sheet stacking apparatus according to claim 5, wherein said guide member is provided retractably from the plane of the frame member.

7. A sheet stacking apparatus according to claim 6, wherein an amount of projection of the guide member is variable depending on a length of the sheet stacked , in the sheet conveying direction, on the first sheet stacking portion.

8. A sheet stacking apparatus according to claim 5, wherein the plane of the frame member, from which the guide member projects , is perpendicular to the sheet conveying direction.

9. An image forming apparatus, comprising:

an image forming portion which forms an image on a sheet; and a sheet stacking apparatus according to claim 5, which stacks a sheet after image formation.

* * * * *